US011879300B2

(12) United States Patent
Knolle et al.

(10) Patent No.: US 11,879,300 B2
(45) Date of Patent: Jan. 23, 2024

(54) SONIC TOOLING HANDLING APPARATUS WITH PIPE TONG AND METHOD

(71) Applicant: Terra Sonic International, LLC, Marietta, OH (US)

(72) Inventors: Mark Knolle, Marietta, OH (US); Edwin Sprout, Walker, WV (US)

(73) Assignee: Terra Sonic International, LLC, Marietta, OH (US)

( * ) Notice: Subject to any disclaimer, the term of this patent is extended or adjusted under 35 U.S.C. 154(b) by 224 days.

(21) Appl. No.: 17/363,215

(22) Filed: Jun. 30, 2021

(65) Prior Publication Data

US 2022/0003051 A1 Jan. 6, 2022

Related U.S. Application Data

(60) Provisional application No. 63/091,004, filed on Oct. 13, 2020, provisional application No. 63/047,337, filed on Jul. 2, 2020.

(51) Int. Cl.

| | |
|---|---|
| ***E21B 19/14*** | (2006.01) |
| ***E21B 19/16*** | (2006.01) |
| ***E21B 7/24*** | (2006.01) |

(52) U.S. Cl.

CPC ..... *E21B 19/14* (2013.01); *E21B 7/24* (2013.01); *E21B 19/16* (2013.01)

(58) Field of Classification Search

CPC ..... E21B 19/14; E21B 19/16; E21B 7/24
See application file for complete search history.

(56) References Cited

U.S. PATENT DOCUMENTS

| | | | | |
|---|---|---|---|---|
| 4,202,653 | A * | 5/1980 | Moller | B65G 1/0442 414/22.57 |
| 6,543,551 | B1 * | 4/2003 | Sparks | B65G 1/08 414/22.58 |
| 2014/0209382 | A1 * | 7/2014 | Smith | E21B 19/14 175/24 |
| 2017/0159379 | A1 * | 6/2017 | Metcalf | E21B 19/14 |
| 2017/0167208 | A1 * | 6/2017 | Craig Wall | E21B 19/008 |

* cited by examiner

*Primary Examiner* — Christopher J Sebesta
(74) *Attorney, Agent, or Firm* — Wood Herron & Evans LLP

(57) ABSTRACT

A sonic tooling handling apparatus includes a gantry support structure with a base frame structure and an overhead frame structure operatively coupled to the base frame structure. The overhead frame structure has a pair of longitudinal beams and a transverse beam coupled to the pair of longitudinal beams. The transverse beam is movable along each of the pair of longitudinal beams. The gantry support structure includes a lifting device coupled to the transverse beam and is movable along part of the transverse beam. The lifting device includes a sonic tooling clamp. The lifting device may raise or lower sonic tooling held by the sonic tooling clamp. The sonic tooling apparatus further includes a removable sonic tooling holding rack having a plurality of stanchions creating at least one sonic tooling holding space for holding sonic tooling. A method of handling sonic tooling and a pipe tong is also disclosed.

16 Claims, 28 Drawing Sheets

SONIC TOOLING HANDLING APPARATUS WITH PIPE TONG AND METHOD

CROSS REFERENCE TO RELATED APPLICATIONS

This application claims the benefit of priority to U.S. Provisional Patent Application Ser. No. 63/047,337, filed Jul. 2, 2020, and U.S. Provisional Patent Application Ser. No. 63/091,004, filed Oct. 13, 2020, the disclosures of which are incorporated herein by reference in their entirety.

TECHNICAL FIELD

The invention relates generally to a material handling apparatus, and more particularly, a sonic tooling handling apparatus with a pipe tong for assisting with coupling and uncoupling sonic tooling to a sonic drill rig and associated methods.

BACKGROUND

Different drilling technologies and systems have been used to form holes and conduct mining and wellbore operations for years. One known drilling technology is sonic drilling. In sonic drilling, a drill pipe or drill string (hereinafter referred to as "sonic tooling") is driven into the ground while being subjected to acoustic vibrations generated by the sonic drill head. Such vibrations help the end of the drill string fluidize the ground beneath the drill string to enable easier further insertion to lower depths within the ground. Fluid may be circulated within the bore hole in a sonic drilling process, such as, for example, when a core sample is to be obtained and analyzed.

Sonic drills include a sonic drill head connected to a drill rig mast, excavator or crane. Sonic tooling, e.g., rods or casings, may be fastened to the sonic drill head using threading or flanging, for example. After a section of sonic tooling is driven into the ground by the sonic drill head, another section of sonic tooling is first fastened to the sonic drill head and then the free end of that section is fastened to the sonic tooling in the ground. This process of adding additional sections of sonic tooling continues until sonic tooling reaches the desired depth.

One section of sonic tooling may be up to 10 feet long and weigh up to 300 pounds. During a driving operation, sections of the sonic tooling are frequently placed in a holding rack which is positioned near the sonic drill. To fasten a section of the sonic tooling to the sonic drill head, the conventional process involves having two or more workers manually extract a section of the sonic tooling from the holding rack and steady it as a threaded end thereof is fastened onto the sonic drill head. Because a large section of the sonic tooling is quite heavy, it requires substantial physical exertion to extract the sonic tooling from the holding rack and fasten it to the sonic drill head. Also, manually handling a section of sonic tooling can be dangerous should the worker mishandle the section and it falls, striking that worker or others.

To reduce the amount of physical exertion, a lifting device, such as a gantry, may be used to lift a section of the sonic tooling out of a holding rack. The drawback to this arrangement is that the lifting device is not part of the holding rack and is another piece of equipment that must be transported to and maintained at the work site. In another design, a holding rack incorporates an integrated lifting device, such as the one described in U.S. Pat. No. 9,951,502, owned by the original Applicant of the present application. One drawback to this arrangement is that the lifting device has a limited range of movement and can move the section of the sonic tooling in only an arcuate trajectory towards the sonic drill head. Another drawback is that this arrangement still requires two or more workers to "load" the section of sonic tooling onto the lifting device before the section can be lifted into place at the sonic drill head.

It would be desirable to provide a sonic tooling handling apparatus that may accommodate a holding rack such that sections of the sonic tooling may be coupled and uncoupled from the sonic drill head without requiring substantial physical exertion.

SUMMARY

To these and other ends, a sonic tooling handling apparatus includes a gantry support structure which includes a base frame structure and an overhead frame structure operatively coupled to the base frame structure. The overhead frame structure has a pair of longitudinal beams with each longitudinal beam having a length and a transverse beam having a length coupled to the pair of longitudinal beams. The transverse beam is movable along at least a part of the length of each of the pair of longitudinal beams. The gantry support structure further includes a lifting device operatively coupled to the transverse beam. The lifting device is movable along at least part of the transverse beam. The lifting device includes a sonic tooling clamp configured to clamp onto the sonic tooling. The lifting device is configured to raise or lower the sonic tooling held by the sonic tooling clamp. The sonic tooling apparatus further includes a sonic tooling holding rack which has a plurality of stanchions configured to create at least one sonic tooling holding space for holding sonic tooling. The sonic tooling holding rack is configured to be removably mounted on the base frame structure of the gantry support structure.

In an embodiment, the transverse beam is coupled to the pair of longitudinal beams by a first and second trolleys, where each of the trolleys is configured so that the transverse beam is movable along at least a part of the length of each of the pair of longitudinal beams. The lifting device is coupled to the transverse beam by a third trolley configured so that the lifting device is movable along at least a part of the length of the transverse beam.

In an embodiment, the lifting device is an air hoist configured to be operatively coupled to a source of high-pressure air and the sonic tooling clamp is rotatably coupled to the air hoist such that the sonic tooling clamped by the sonic tooling clamp may be rotated about a vertical axis of the air hoist.

In an embodiment, the base frame structure has four corners and each corner is supported by an adjustable corner support with a foot pad. Each corner support is independently vertically movable relative to the base frame structure to accommodate the sonic tooling handling apparatus sitting on an uneven support surface. Each foot pad is pivotable to accommodate the support surface being sloped.

In an embodiment, the gantry support structure includes an upright frame structure coupling the overhead frame structure to the base frame structure. The upright frame structure is selectably adjustable so as to change a vertical distance between the pair of longitudinal beams and the base frame structure.

In an embodiment, the sonic tooling holding rack has four corners and the plurality of stanchions includes four corner stanchions that are positioned at corresponding ones of the four corners. Each of the four corner stanchions includes a cradle member configured to hold at least a portion of sonic tooling. The plurality of stanchions may include two intermediate stanchions positioned between the four corner stanchions so as to create first and second sonic tooling holding spaces for holding the sonic tooling. The two intermediate stanchions may be movable relative to the four corner stanchions such that the size of the first and second sonic tooling holding spaces may either increased or decreased. Two of the four corner stanchions may each include a transverse extension member that is configured to pivot between a first position and a second position, wherein in the first position the transverse extension member rests atop the intermediate stanchion.

In an embodiment, an end of each of the pair of longitudinal beams extends outwardly beyond a first side edge of the base frame structure so that the lifting device may lower or raise the sonic tooling beyond the first side edge of the base frame structure. Also, an end of the transverse beam extends outwardly beyond a second side edge of the base frame so that the lifting device may lower or raise the sonic tooling beyond the second side of the base frame structure.

In an embodiment, the base frame structure has at least one corner and that at least one corner does not include a vertical stanchion thereon. In another embodiment, the base frame structure has four corners and none of those four corners includes a vertical stanchion thereon.

The invention also contemplates a method of transferring the sonic tooling between a sonic tooling handling apparatus and a sonic drill rig having a sonic drill head. The sonic tooling handling apparatus has a sonic tooling holding rack holding at least one piece of sonic tooling and a lifting device with a sonic tooling clamp disposed above and movable in a longitudinal direction and a transverse direction relative to the sonic tooling holding rack. The method includes clamping the at least one piece of sonic tooling with the sonic tooling clamp, lifting the at least one piece of sonic tooling above the sonic tooling holding rack, moving the sonic tooling clamp in a longitudinal direction and/or a transverse direction so as to align an end of the at least one piece of sonic tooling with the sonic drill head, coupling the end of the at least one piece of sonic tooling to the sonic drill head, and finally, releasing the at least one piece of sonic tooling from the sonic tooling clamp.

The invention also contemplates a pipe tong that includes first and second gripping structures pivotally connected to one another, wherein each gripping structure has a jaw configured to grip sonic tooling. The first and second gripping structures are movable between open and closed positions. The pipe tongs also includes first and second linking members, each having first and second ends. The first ends being pivotally connected to respective ends of the first and second gripping structures and the second ends are pivotally connected to each other. The pipe tongs also includes a pin connecting the second ends of the first and second linking members. The pipe tongs also includes a latch lever rotatably connected to the first or second gripping structures. The latch lever is configured to operably engage with the pin to retain the first and second gripping structures in the open position.

In an embodiment, the pipe tong further includes a clevis connected to the pin. The first and second gripping structures move to the closed position to grip the sonic tooling when the clevis is moved upwardly.

In an embodiment, the pipe tong further includes a stop pin mounted to the first or second gripping structures to which the latch lever is also connected. The stop pin is configured to limit the rotation of the latch level relative to the first or second gripping structures.

BRIEF DESCRIPTION OF THE DRAWINGS

The accompanying drawings, which are incorporated in and constitute a part of this specification, illustrate one or more embodiments of the invention and, together with a general description of the invention given above, and the detailed description given below, serve to explain the invention.

DETAILED DESCRIPTION

Figure 1A:
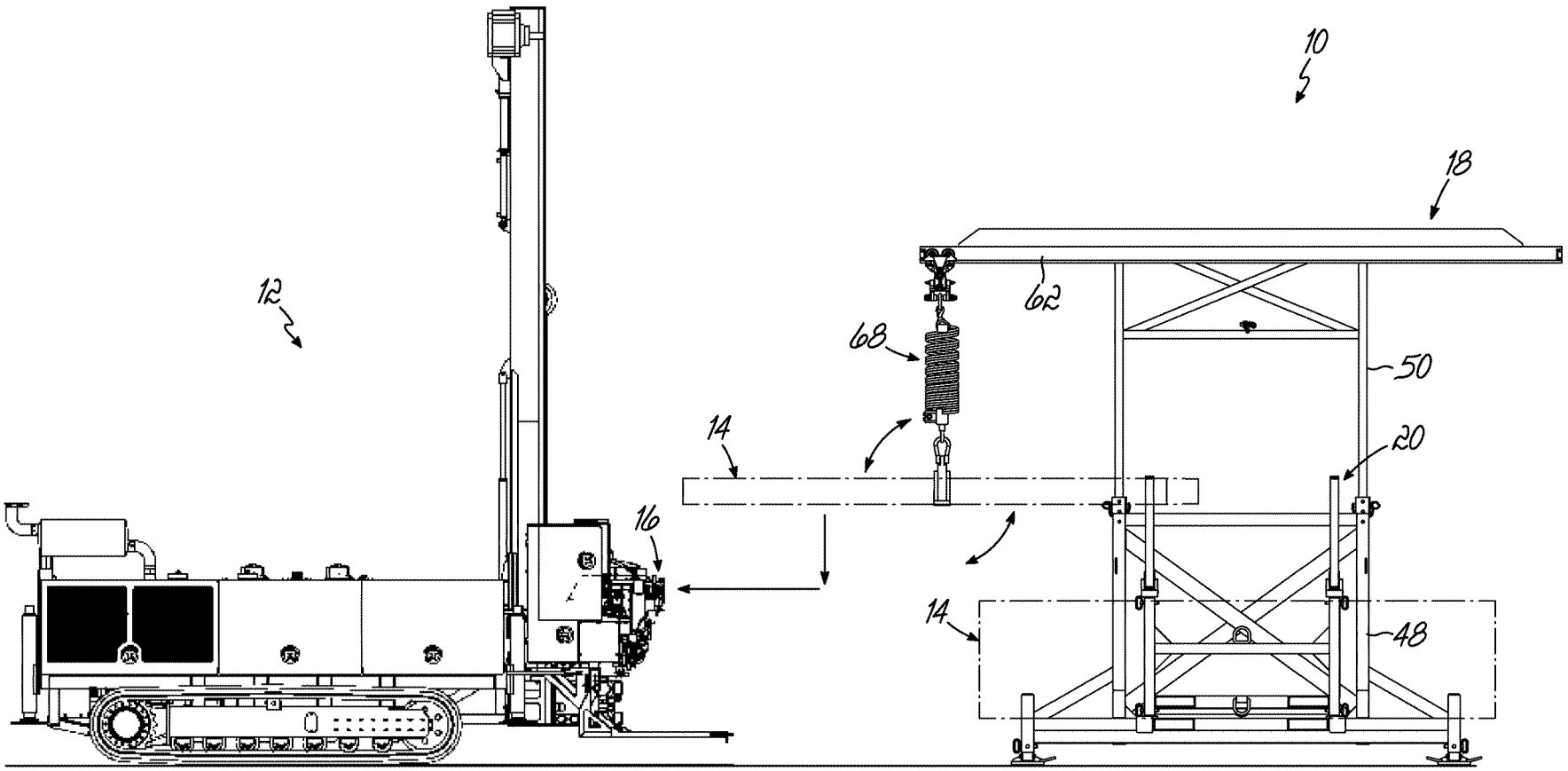
FIG. 1A is an elevation view of a sonic tooling handling apparatus according to an embodiment of the invention positioned adjacent a sonic drill rig.
Figure 1B:
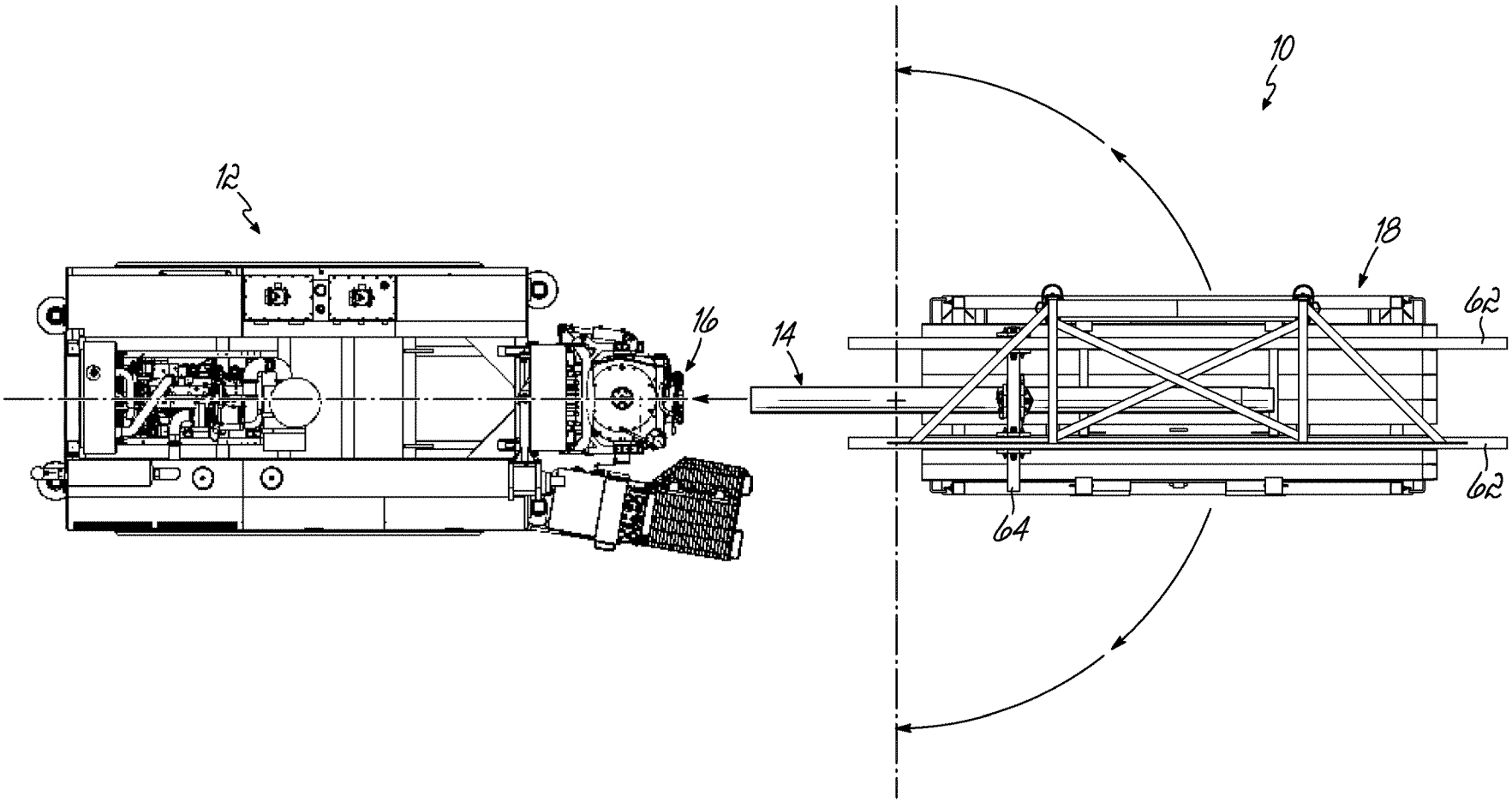
FIG. 1B is a top view of the sonic tooling handling apparatus and sonic drill rig of FIG. 1A.

A sonic tooling handling apparatus 10 according to an embodiment of the invention is illustrated in FIGS. 1A and 1B. The sonic tooling handling apparatus 10 is positioned adjacent to a sonic drill rig 12 so that the sonic tooling 14 may be uploaded from the sonic tooling handling apparatus 10 and coupled to a sonic drill head 16 of the sonic drill rig 12. The sonic tooling handling apparatus 10 has two primary components, namely a gantry support structure 18 and a sonic tooling holding rack 20.

Figure 1C:
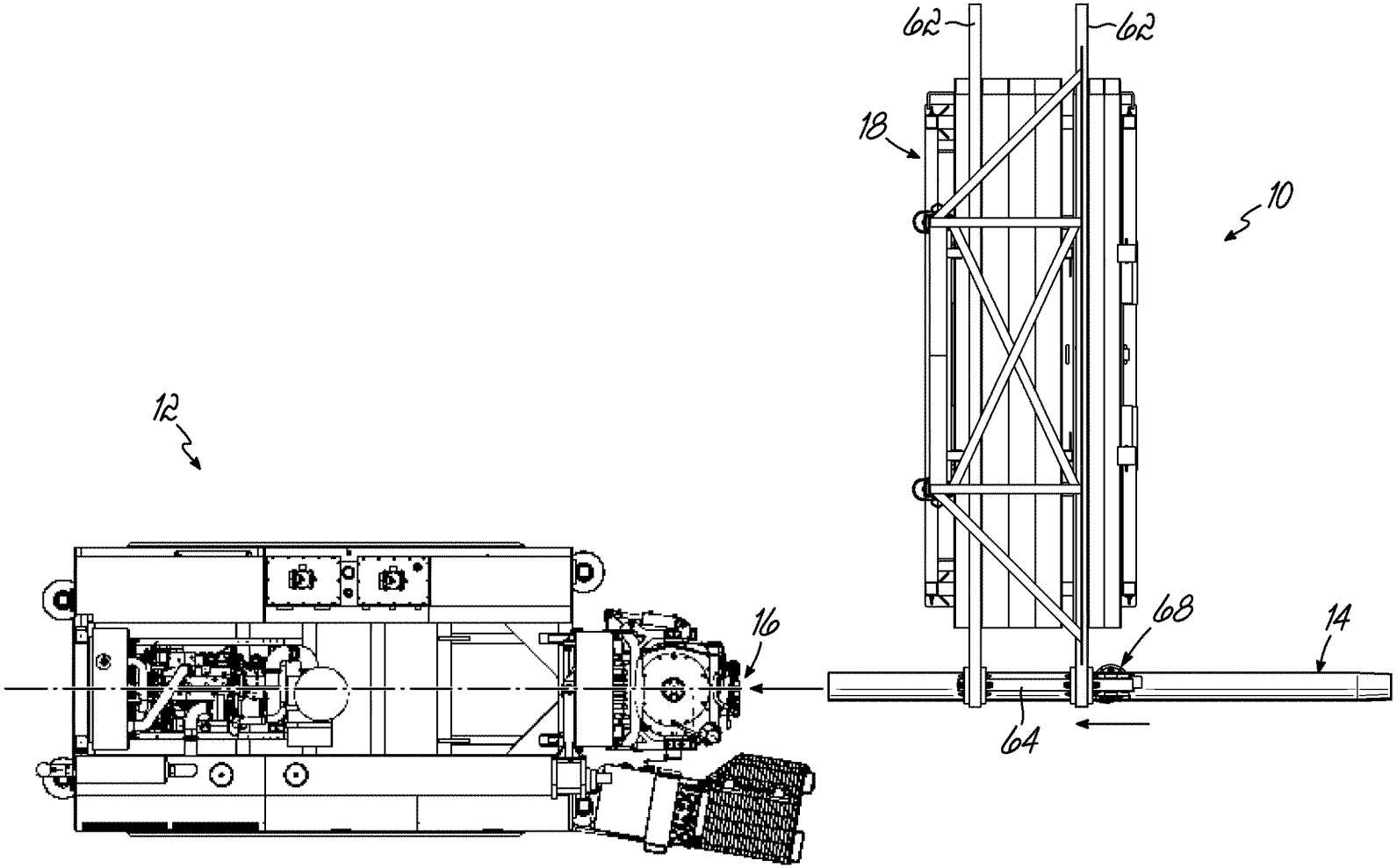
FIG. 1C is top view of the sonic tooling handling apparatus of FIG. 1A turned 90 degrees to the sonic drill rig.

As illustrated in FIG. 1B, the centerline of the sonic tooling handling apparatus 10 is generally coincident (aligned with and parallel to) with the longitudinal axis of the sonic drill rig 12 as seen from above. In an embodiment, the sonic tooling handling apparatus 10 may be moved laterally relative to the longitudinal axis of the sonic drill rig 12 such that the centerline is no longer aligned with the longitudinal axis of the sonic drill rig 12, but still remains parallel to it. In an embodiment, the sonic tooling handling apparatus 10 may be positioned along varying angles relative to the sonic drill rig 12 as exemplified by the 180 degree arc sweeping to either side of the sonic drill rig 12 in FIG. 1B and still be capable of loading and unloading sonic tooling to and from the sonic drill rig 12. By way of example, FIG. 1C illustrates the sonic tooling handling apparatus 10 positioned 90 degrees to the longitudinal axis of the sonic drill rig 12 and loading sonic tooling onto the sonic drill rig 12.

With the arrangement in FIG. 1A, the operator would face the sonic tooling handling apparatus 10 such that his left side would be closer to the sonic drill rig 12. The sonic tooling handling apparatus 10, however, may load and unload sonic tooling from either end of the sonic tooling handling apparatus 10. Consequently, the sonic tooling handling apparatus 10 shown in FIG. 1A may be turned 180 degrees such that when an operator faces the sonic tooling handling apparatus 10 his right side would be closer to the sonic drill rig 12.

Because the sonic tooling handling apparatus 10 may be placed in various positions (laterally or rotationally) relative to the sonic drill rig 12 and still maintain all of its functionality, it is easier to set up the sonic tooling handling apparatus 10 to avoid obstacles or challenging terrain at the job site.

Figure 2:
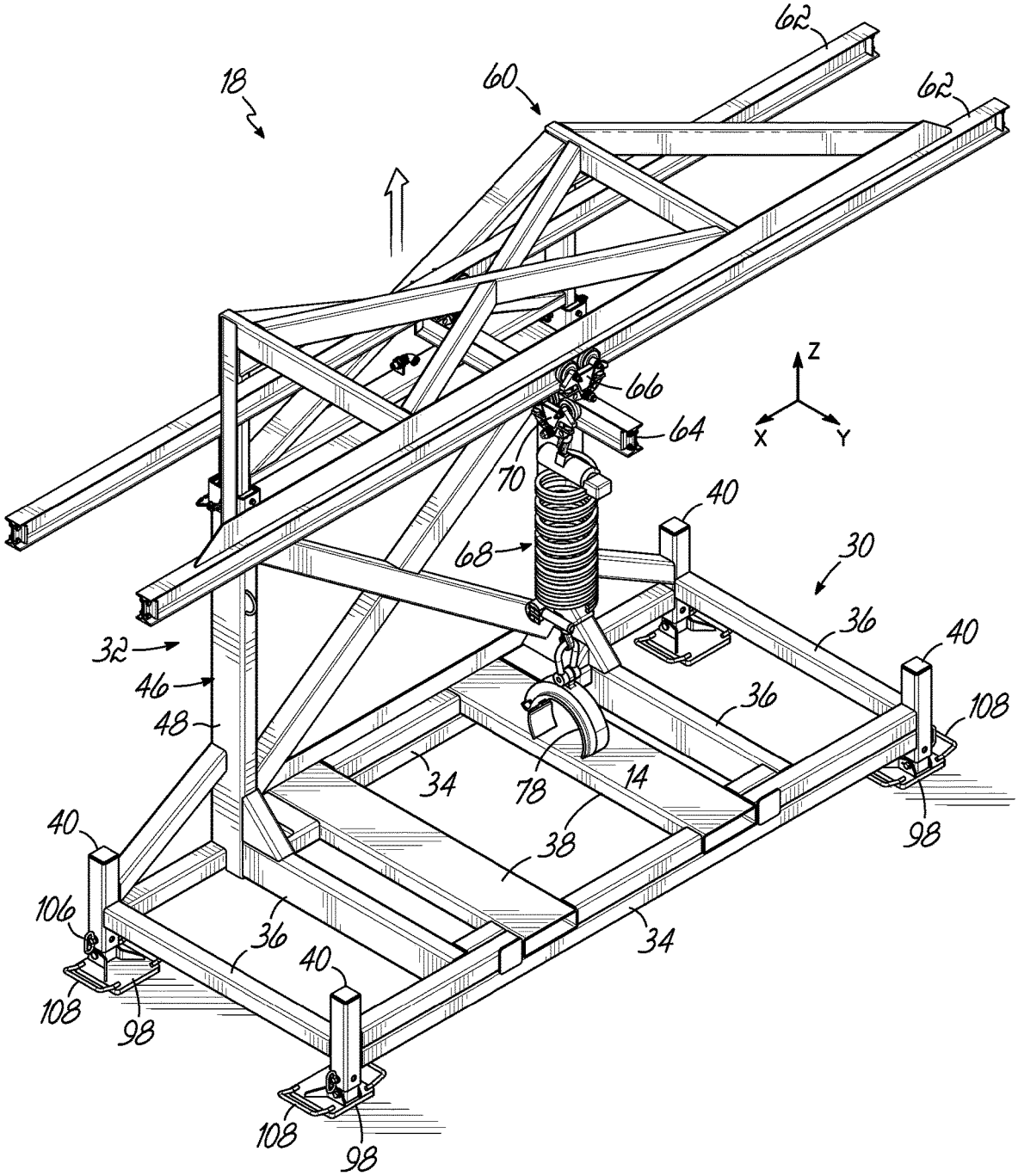
FIG. 2 is perspective view of the sonic tooling handling apparatus of FIG. 1 with the sonic tooling holding rack removed and the upright frame structure in the lowered position.
Figure 3:
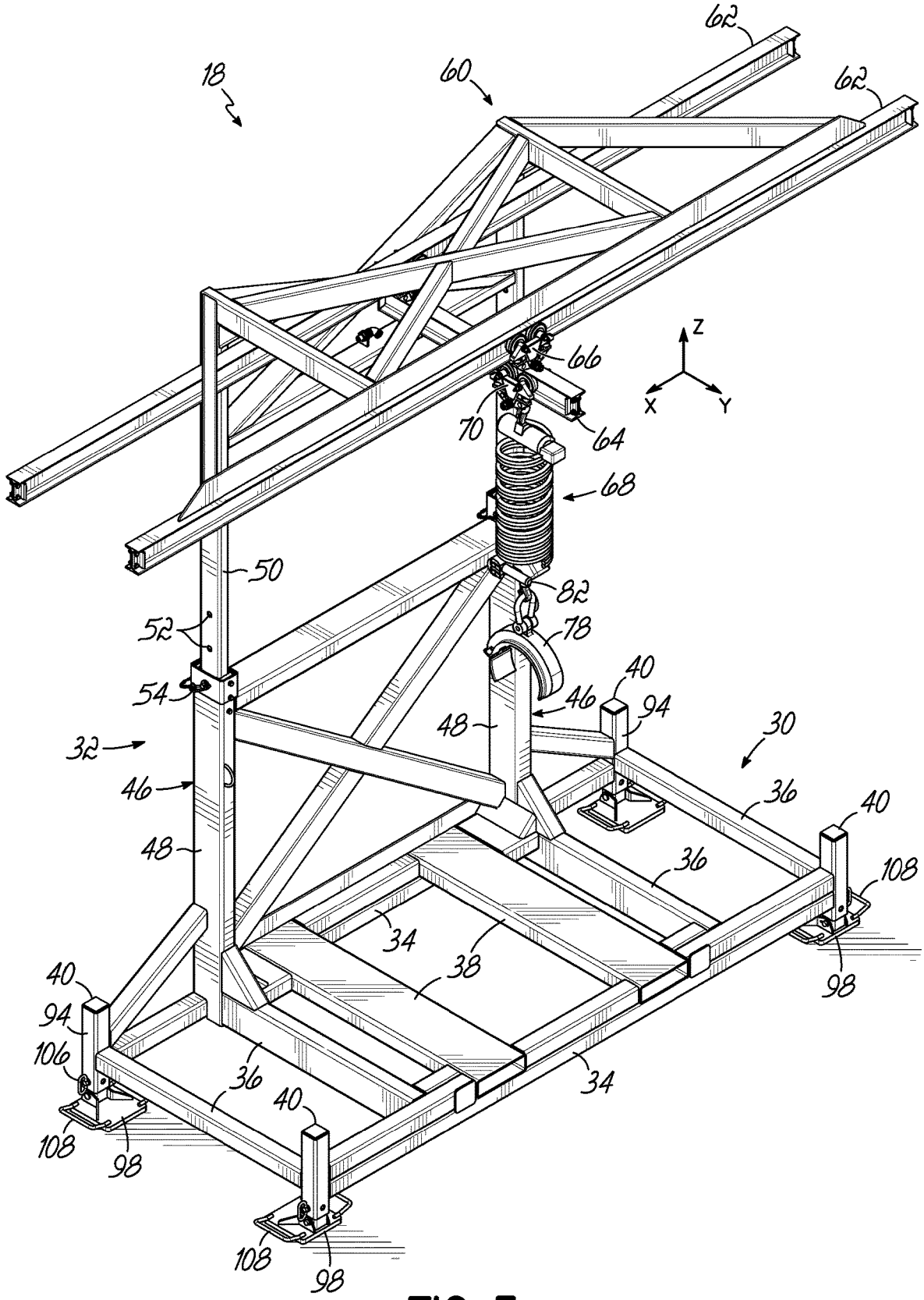
FIG. 3 is perspective view of the sonic tooling handling apparatus of FIG. 2 with the upright frame structure in the raised position.

To assist with describing the sonic tooling handling apparatus 10 and its various components herein, the orthogonal X, Y, and Z axes depicted in FIG. 2 represent the longitudinal, transverse, and vertical orientations, respectively. Referring to FIGS. 2, 3, 4A, and 4B, the gantry support structure 18 includes a base frame structure 30 and an upright frame structure 32 is illustrated in more detail in FIGS. 2, 3, 4A, and 4B. The base frame structure 30 includes longitudinal frame members 34, transverse frame members 36, and open-ended box members 38. As will be discussed below, the open-ended box members 38 are sized and spaced apart so that a pair of forklift forks may be inserted therein such that the gantry support structure 18 may be lifted up and moved to a desired location. The base frame structure 30 further includes adjustable corner supports 40, which will be described in greater detail below, disposed at and to support the four respective corners of the base frame structure 30. With continued reference to FIGS. 2, 3, 4A, and 4B, the upright frame structure 32 includes spaced apart vertical frame members 46 comprising a fixed lower support 48 and an adjustable upper support 50 manually movable within the interior of the fixed lower support 48. The adjustable upper support 50 includes a plurality of throughholes 52 that may be used in conjunction with a pin 54 placed in a hole 56 in the fixed lower support 48 to position the adjustable upper supports 50 at a desired height relative to the base frame structure 30. An overhead frame structure 60 is affixed atop the adjustable upper supports 50. The overhead frame structure 60 includes a pair of spaced apart longitudinal beams 62, such as I-beams, and a transverse beam 64, such as an I-beam, coupled to the longitudinal beams 62 with a pair of trolleys 66. The trolleys 66 allow the transverse I-beam 64 to manually move along at least part of the length of the longitudinal I-beams 62 in a longitudinal direction as depicted by Arrows A in FIG. 5. In an embodiment, the trolleys 66 allow the transverse I-beam 64 to move end-to-end along the length of the longitudinal I-beams 62. A lifting device 68 (here an air hoist), is coupled to the transverse I-beam 64 with a trolley 70 that allows the air hoist 68 to manually move along at least part of the length of the transverse I-beam 64 in transverse direction as depicted by Arrows B in FIG. 5. In an embodiment, the trolley 70 allows the air hoist 68 to move end-to-end along the length of the transverse I-beam 64. Because of adjustable upper support 50, the upright frame structure is selectably adjustable so that an operator may change the vertical distance between the longitudinal I-beams 62 and the base frame structure 30.

In an embodiment, at least one end of the longitudinal I-beams 62 may extend outwardly beyond a first side edge of the base frame structure 30 so that the air hoist 68 may lower or raise the sonic tooling 14 beyond the first side edge of the base frame structure 30. In an embodiment, at least one end of the transverse I-beam 64 may extend outwardly over a second side edge of the base frame structure 30 as represented by the dashed rectangular box in FIG. 4A such that the air hoist 68 may lower or raise the sonic tooling 14 beyond the second side edge of the base frame structure 30. In this arrangement, the air hoist 68 and a sonic tooling clamp such as a pipe tong may also extend over the side edge of the sonic tooling holding rack 20 such that the sonic tooling clamp may be lowered all the way to the support surface, e.g., the ground, and pick up the sonic tooling 14 positioned on the support surface.

Figure 4A:
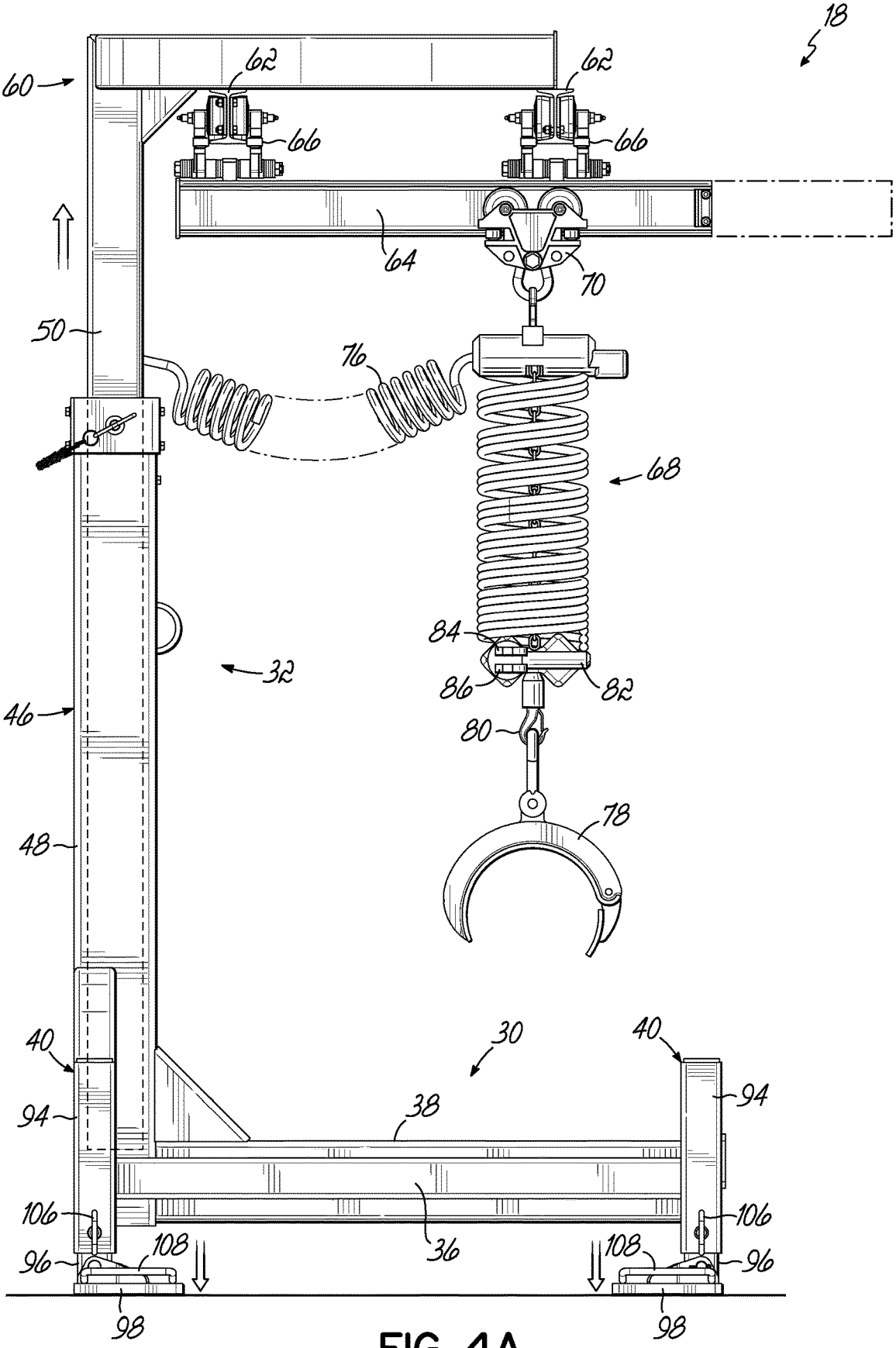
FIG. 4A is a side view of the sonic tooling handling apparatus of FIG. 2.
Figure 4B:
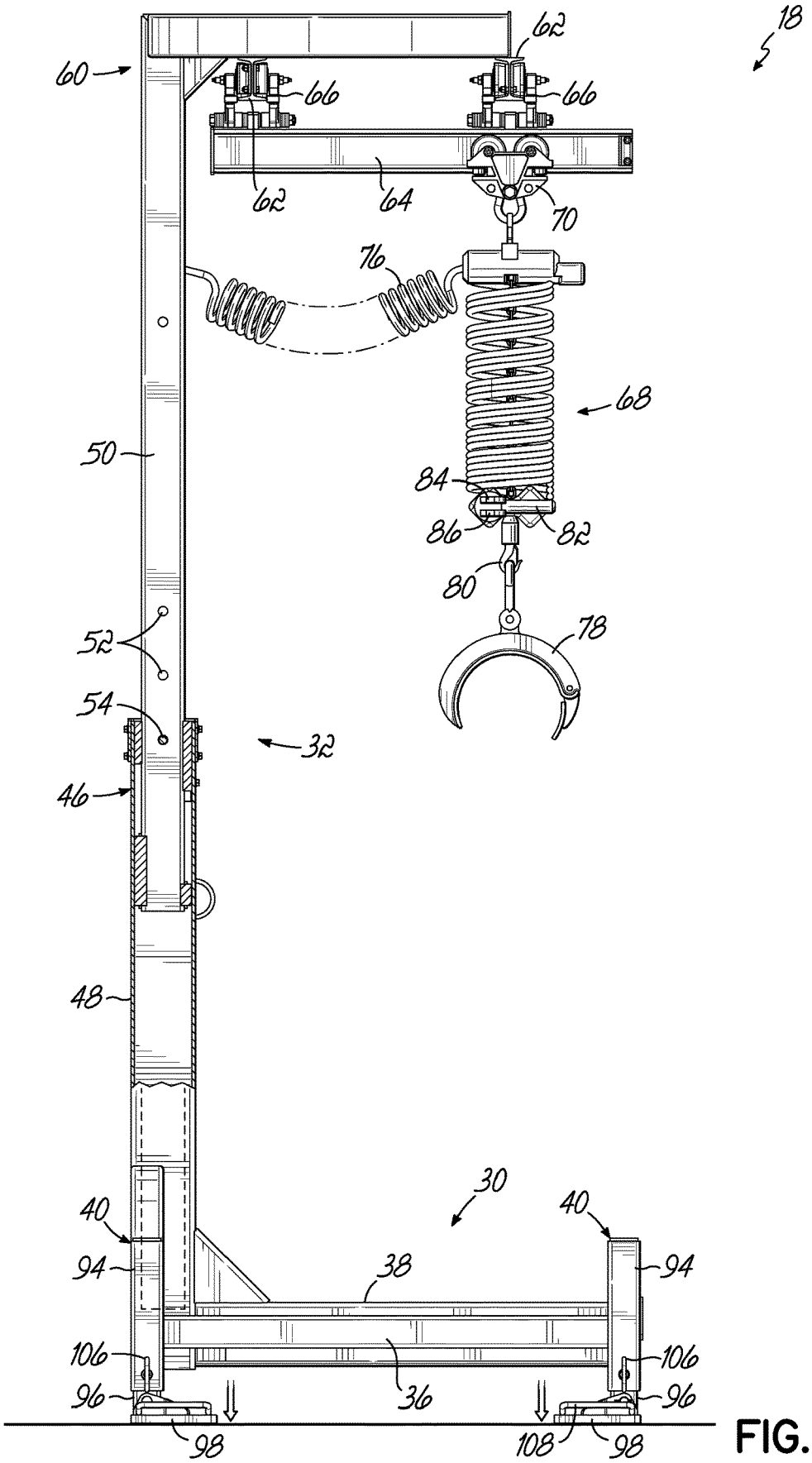
FIG. 4B is a side view of the sonic tooling handling apparatus of FIG. 3.
Figure 5:
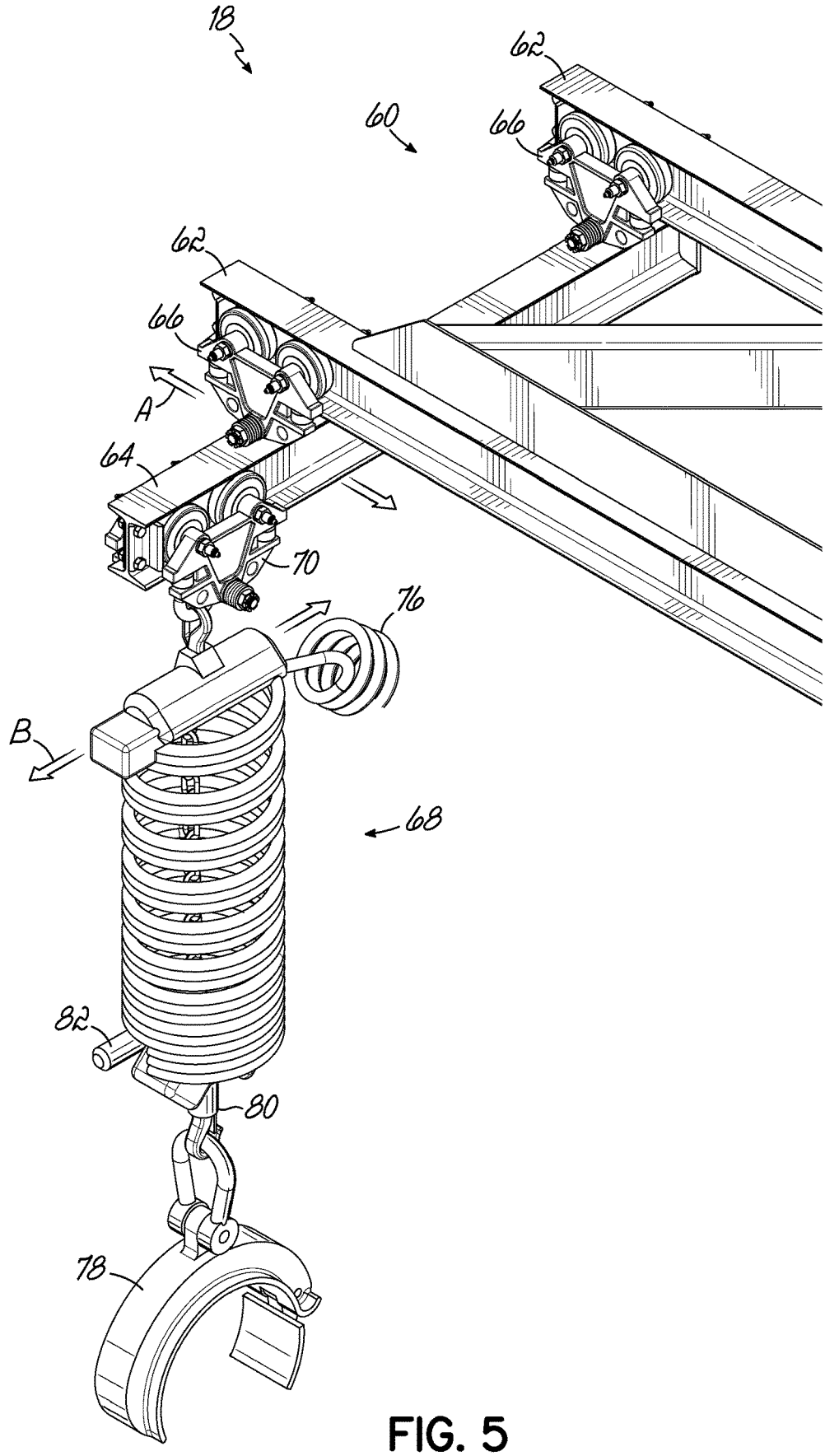
FIG. 5 is an enlarged partial perspective view of the air hoist of the sonic tooling handling apparatus of FIG. 1.

With continued reference to FIGS. 4A, 4B, and 5, the air hoist 68 is connected to a source of high-pressure air via a flexible air hose 76. In one embodiment, the flexible air hose 76 is connected to the sonic drill rig 12 which includes a tank of high-pressure air. A sonic tooling clamp such as a pipe tong 78 is operatively coupled to a swivel hook 80 coupled to the bottom on the air hoist 68. The air hoist 68 further includes a handle 82 and adjacent buttons 84, 86 which controls the air hoist 68 to move the pipe tong 78 up and down. Using the handle 82, an operator of the sonic tooling handling apparatus 10 may move the air hoist 68 along transverse I-beam 64 as well as move the transverse I-beam 64 along longitudinal I-beam 62.

Figure 6:
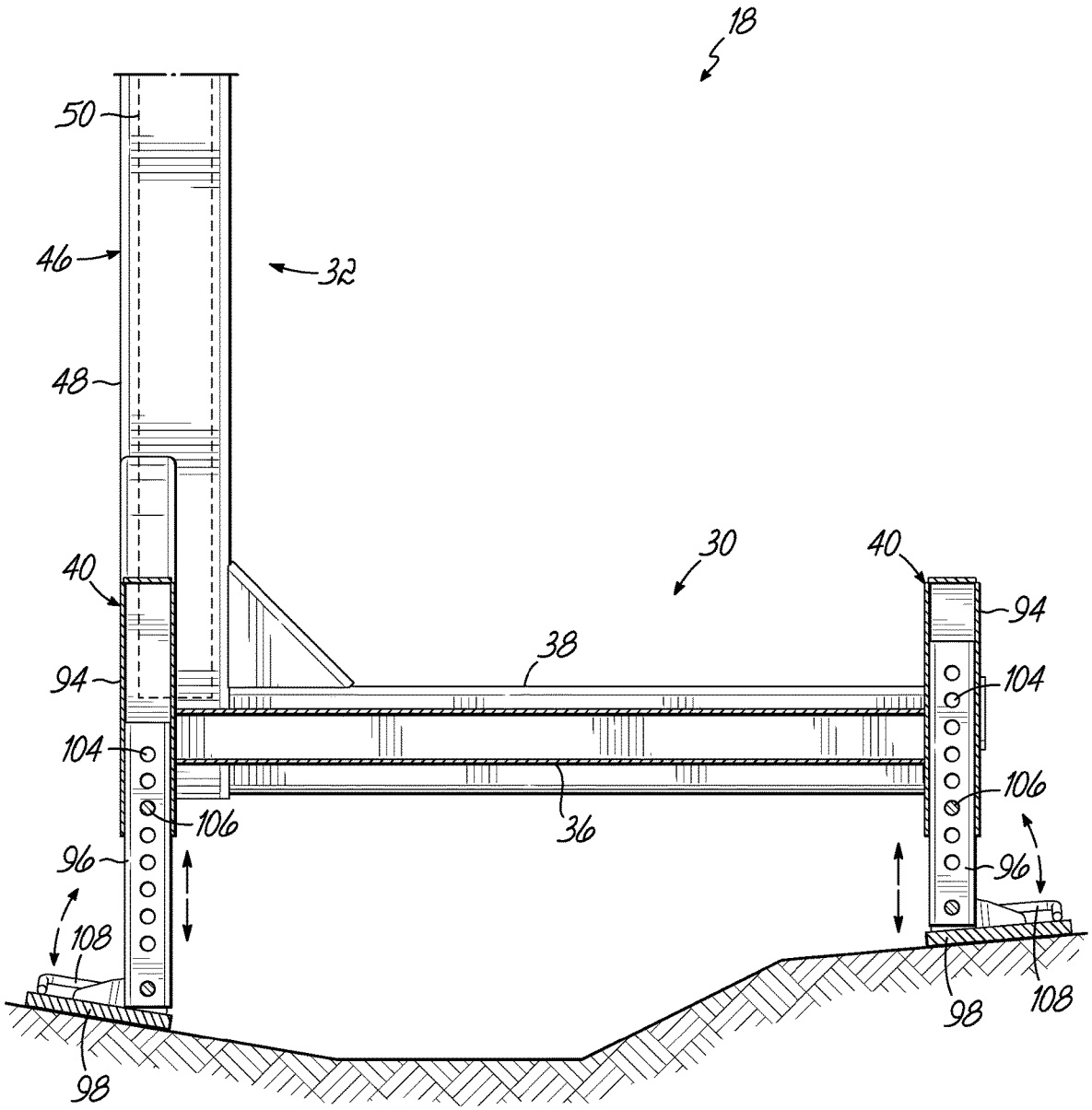
FIG. 6 is a partial side view of the sonic tooling handling apparatus of FIG. 2.
Figure 7B:
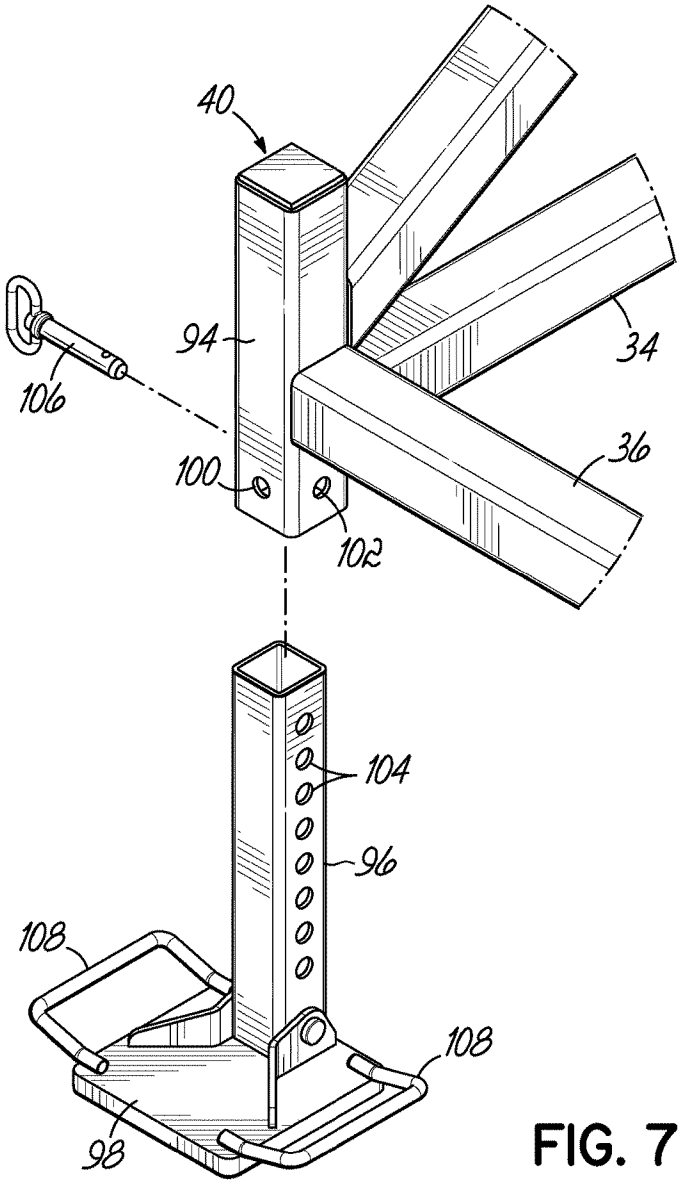
FIG. 7B is a disassembled perspective view of the adjustable corner support of FIG. 7A with the movable post member rotated 90 degrees.
Figure 7A:
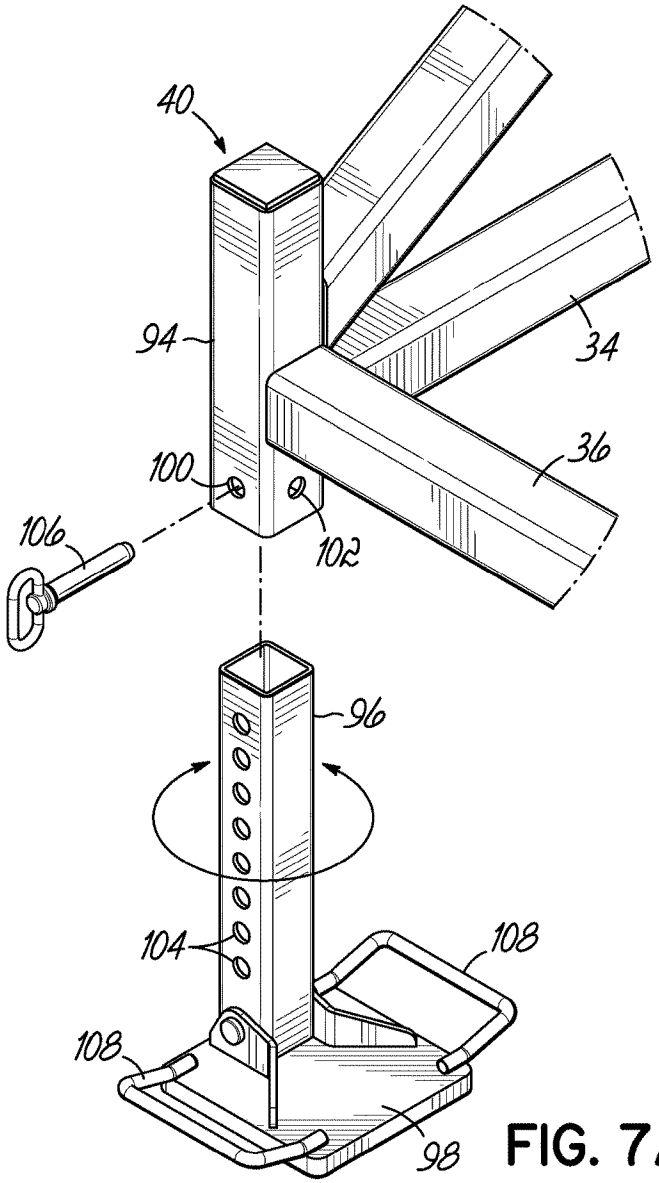
FIG. 7A is a disassembled perspective view of an adjustable corner support of the sonic tooling handling apparatus of FIG. 1.

With reference to FIGS. 6, 7A, and 7B, each adjustable corner support 40 includes a fixed receiver member 94 coupled to a terminal end of one of the longitudinal frame members 34 and to a terminal end of one of the transverse frame members 36. Each adjustable corner support 40 includes a movable post member 96 that may be selectively adjustably slid into the interior of the fixed receiver member 94. Each adjustable corner support 40 and, more specifically, the movable post member 96 may be moved relative to the base frame structure 30 independently of the other adjustable corner supports 40 and movable post member 96. A foot pad 98 is pivotably attached to the lower end of the movable post member 96. The fixed receiver member 94 includes throughholes 100, 102 that, when aligned with throughholes 104 on movable post member 96, may be engaged by a pin 106 to fix the movable post member 96 relative to the fixed receiver member 94. As depicted in FIG. 6, the movable post member 96 may be adjusted within the fixed receiver member 94 to accommodate uneven (i.e., having different elevations) terrain at each corner of the base frame structure 30. The pivotable foot pad 98 also accommodates terrain that has a slope to it which may be different at each corner of the base frame structure 30. Each foot pad 98 may include one or more handles 108 to assist the operator in moving the movable post member 96 and/or the foot pad 98.

Because the throughholes 100, 102 are arranged on adjacent sides of the fixed receiver member 94, the movable post member 96 may be turned by 90 degree increments relative to the fixed receiver member 94. In FIG. 7A, the fixed receiver member 94 is oriented such that the foot pad 98 is turned inward to reside under the base frame structure 30. This orientation makes the sonic tooling handling apparatus 10 narrow, which is best suited for transporting the sonic tooling handling apparatus 10 to a job site. In FIG. 7B, the movable post member 96 is turned 90 degrees (relative to FIG. 7A) and the pin 106 will be inserted into throughhole 102. FIG. 6 illustrates the movable post member 96 oriented such that foot pad 98 is pointed outwardly, which should provide the sonic tooling handling apparatus 10 with the widest "footprint" and the greatest stability.

Figure 8A:
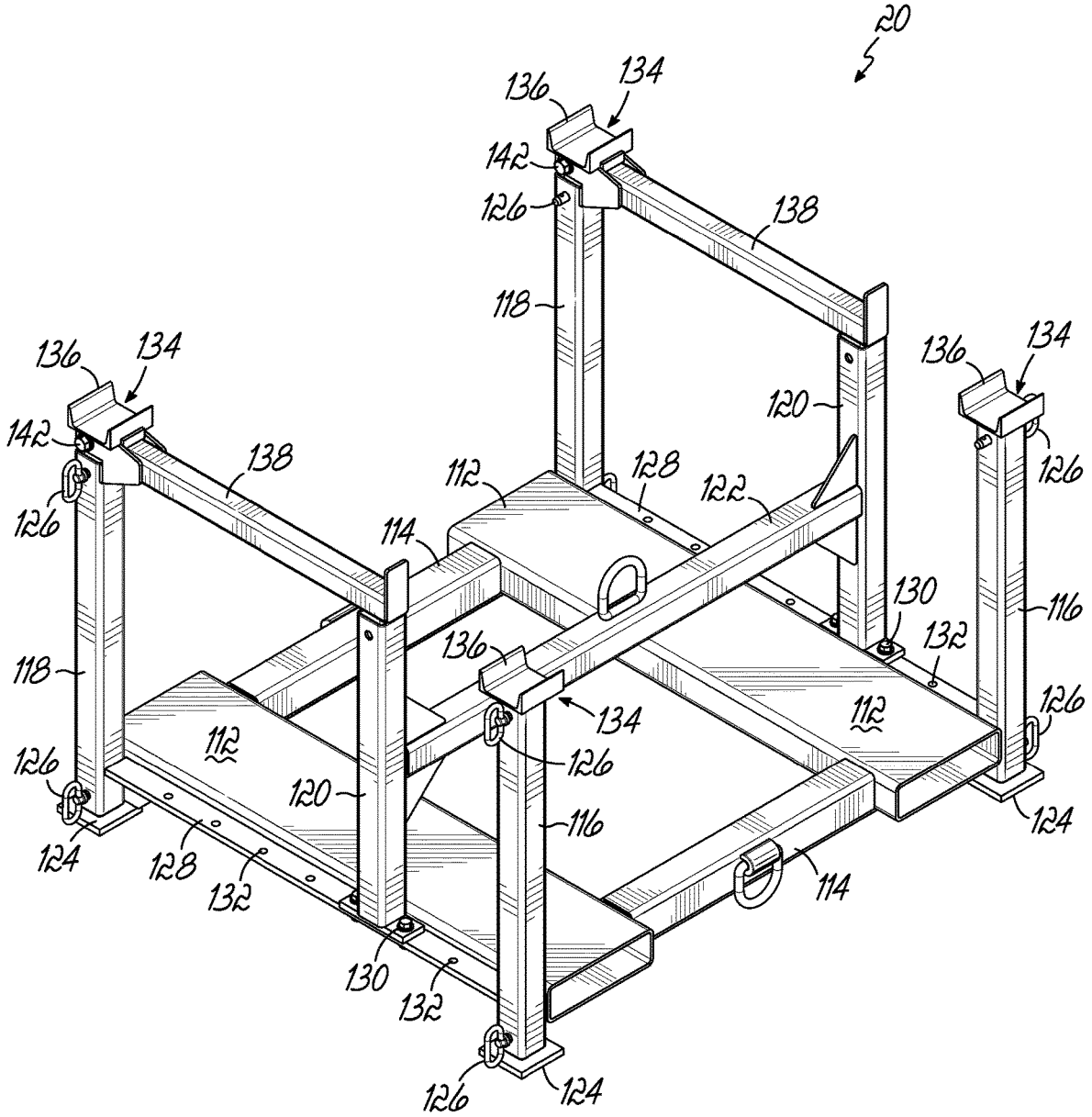
FIG. 8A is a perspective view of a sonic tooling holding rack with transverse members in their lowered positions.

With reference to FIG. 8A, the sonic tooling holding rack 20 includes open-ended box members 112 coupled to longitudinal frame members 114. Similar to the open-ended box members 38, the open-ended box members 112 are sized and spaced apart so that a pair of forklift forks may be inserted therein such that the sonic tooling holding rack 20 may be lifted and moved to a desired location, such as onto the gantry support structure 18 (see FIGS. 10B and 11C). The sonic tooling holding rack 20 further includes four corner stanchions 116, 118 and two intermediate stanchions 120. A cross member 122 spans between and connects to the two intermediate stanchions 120. Each of the corner stanchions 116, 118 include foot pads 124 that are adjustable relative to the corner stanchions 118 in much the same manner as the adjustable corner supports 40 on the base frame structure 30 are adjustable to accommodate uneven terrain so that the sonic tooling holding rack 20 may remain as level as possible. The foot pads 124 may be locked into position with a removable pin 126.

Figure 8B:
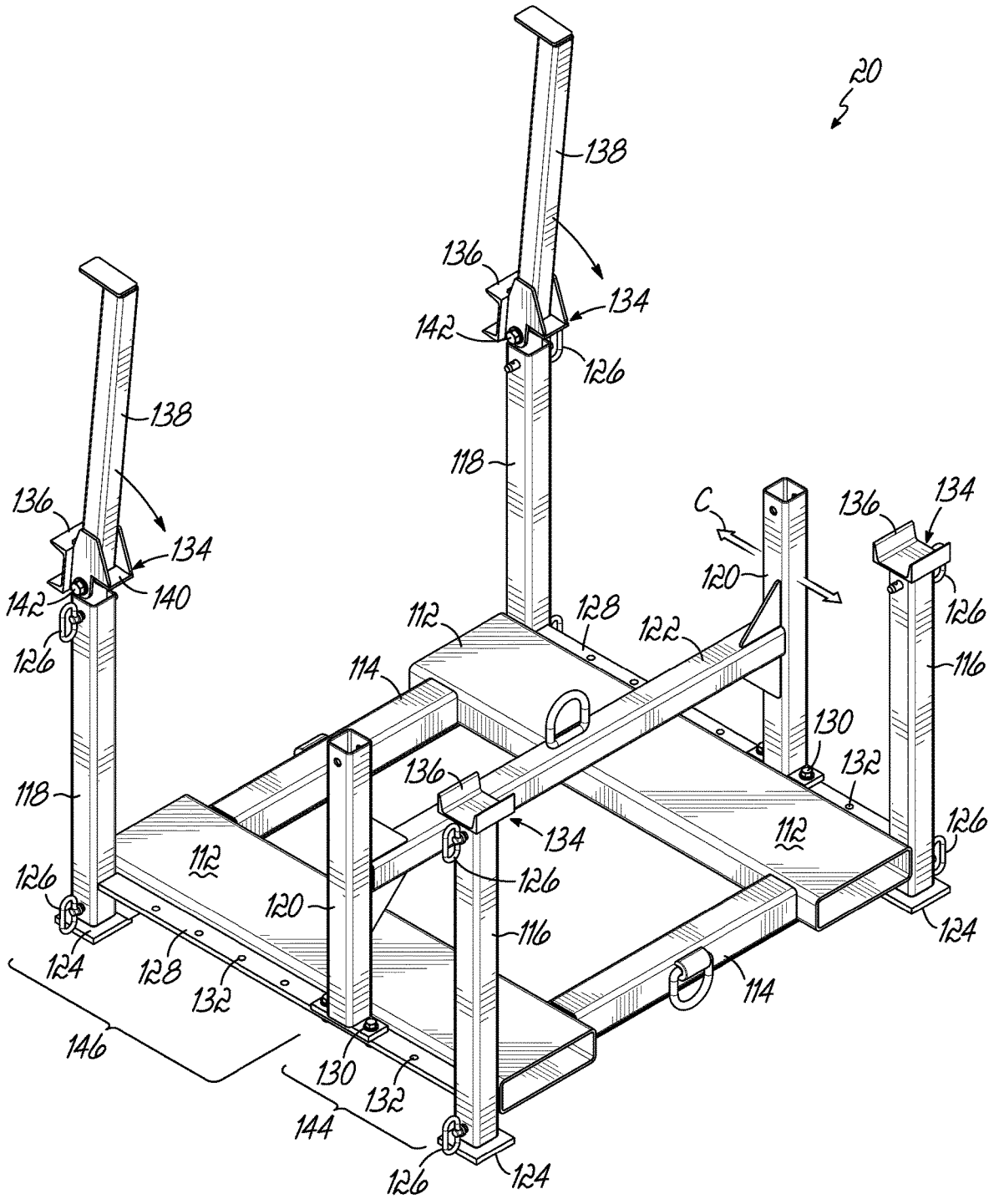
FIG. 8B is a perspective view of the sonic tooling holding rack of FIG. 8A with the transverse members in raised positions.

The intermediate stanchions 120 are removably coupled to a flange member 128 by fasteners 130 inserted into one of the spaced apart throughholes 132 in the flange member 128. The intermediate stanchions may be repositioned laterally along the flange member 128 (see Arrow C in FIG. 8B) as dictated by the size and quantity of the sonic tooling being held in the sonic tooling holding rack 20. As such, a first sonic tooling holding space 144 is located between corner stanchions 116 and the intermediate stanchions 120 and a second sonic tooling holding space 146 is located between corner stanchions 118 and the intermediate stanchions 120 as illustrated in FIG. 8B.

The corner stanchions 118 further include extension members 134 which are vertically adjustable within the corner stanchions 118. The removable pin 126 inserted into throughhole 140 (FIG. 10A) in the extension member 134 vertically fixes the extension member 134 relative to the corner stanchions 118. By raising the extension member 134 upwards relative to the corner stanchions 118, additional sonic tooling may be added to the sonic tooling holding rack 20. The top of each extension member 134 includes a cradle member 136 that is configured to hold at least a portion of the sonic tooling 14 as illustrated in FIG. 11E.

Transverse extension members 138 are attached to the corner stanchions 116 via removable pins 126. When the pin 126 is removed, the transverse extension member 138 may be lifted out of the corner stanchion 118. The transverse extension members 138 may pivot about fasteners 142 between a first or down position (FIG. 8A) and a second or up position (FIG. 8B). In the down position, the transverse extension member 138 extends from the corner stanchion 118 and the free end rests atop the intermediate stanchion 120. In the up position, the transverse extension member 138 is pivoted upward away from the intermediate stanchion 120 to provide access to the sonic tooling 14 positioned below the transverse extension member 138 in the down position. In the up position, the transverse extension member 138 allows additional sonic tooling 14 to be added to the sonic tooling holding rack 20 especially when extension members 134 are also extended upwardly. The transverse extension member 138 may include the cradle member 136 to hold at least a portion of the sonic tooling 14.

Figure 9:
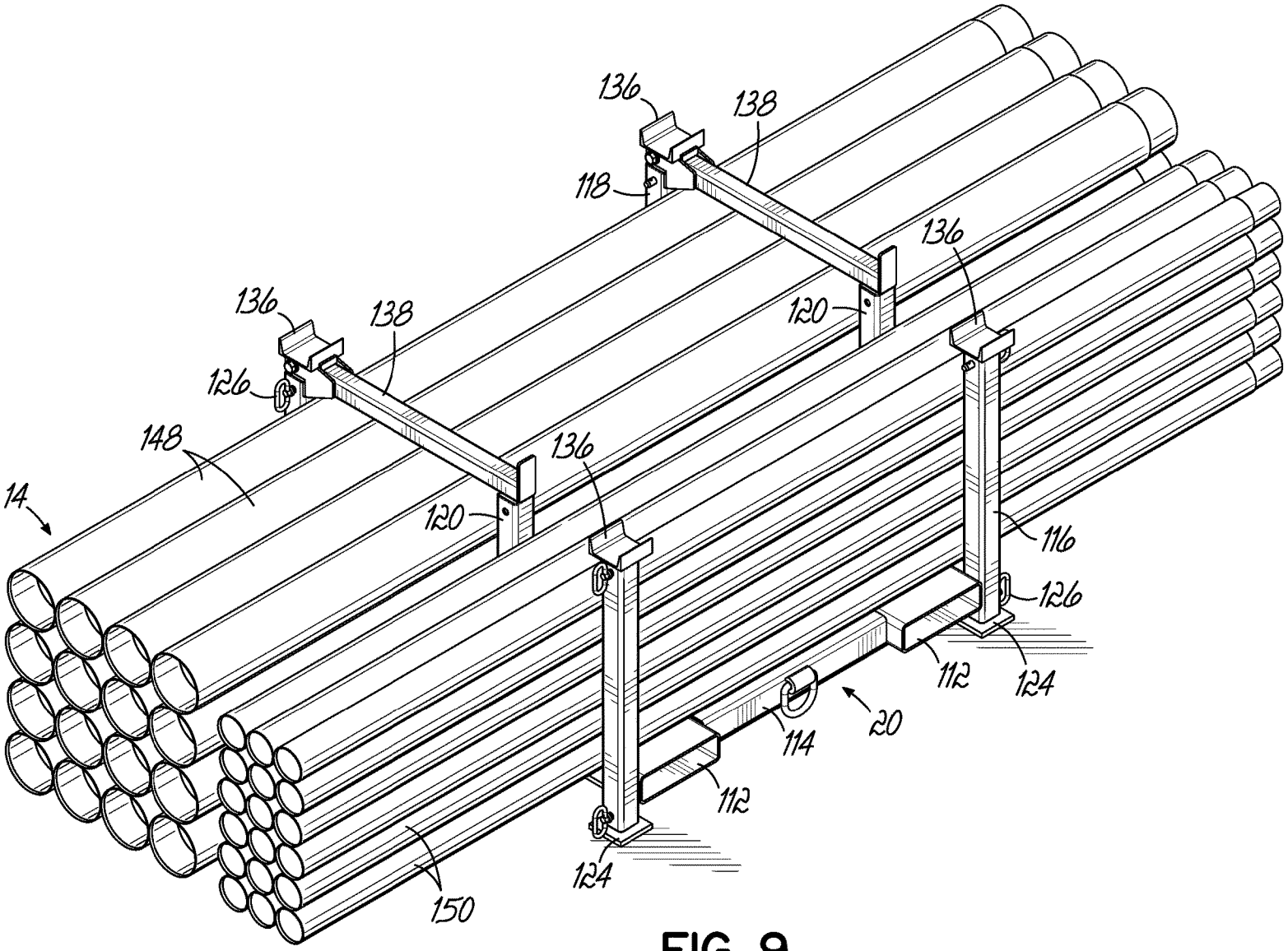
FIG. 9 is a perspective view of the sonic tooling holding rack of FIG. 8A loaded with drill rods and casings.

FIG. 9 shows the sonic tooling 14 arranged in sonic tooling holding rack 20. The sonic tooling 14 may be casings 148 or drill rods 150, for example, with the casings 148 typically having a larger diameter than the drill rods 150. The intermediate stanchion 120 may be moved either towards the corner stanchions 116 to create more room for additional casings 148 or toward the corner stanchions 118 to create more room for additional drill rods 150. In other words, as the intermediate stanchions 120 are moved relative to the corner stanchion 116, the size of the first and second sonic tooling holding spaces 144, 146 may either increase or decrease as dictated by the quantity of casings 148 and/or drill rods 150 to be placed in the sonic tooling holding rack 20. As previously discussed, the extension members 134 maybe be extended and the transverse extension members 138 may be placed in the open position so that the additional sonic tooling 14 may be added to the sonic tooling holding rack 20.

Figure 10A:
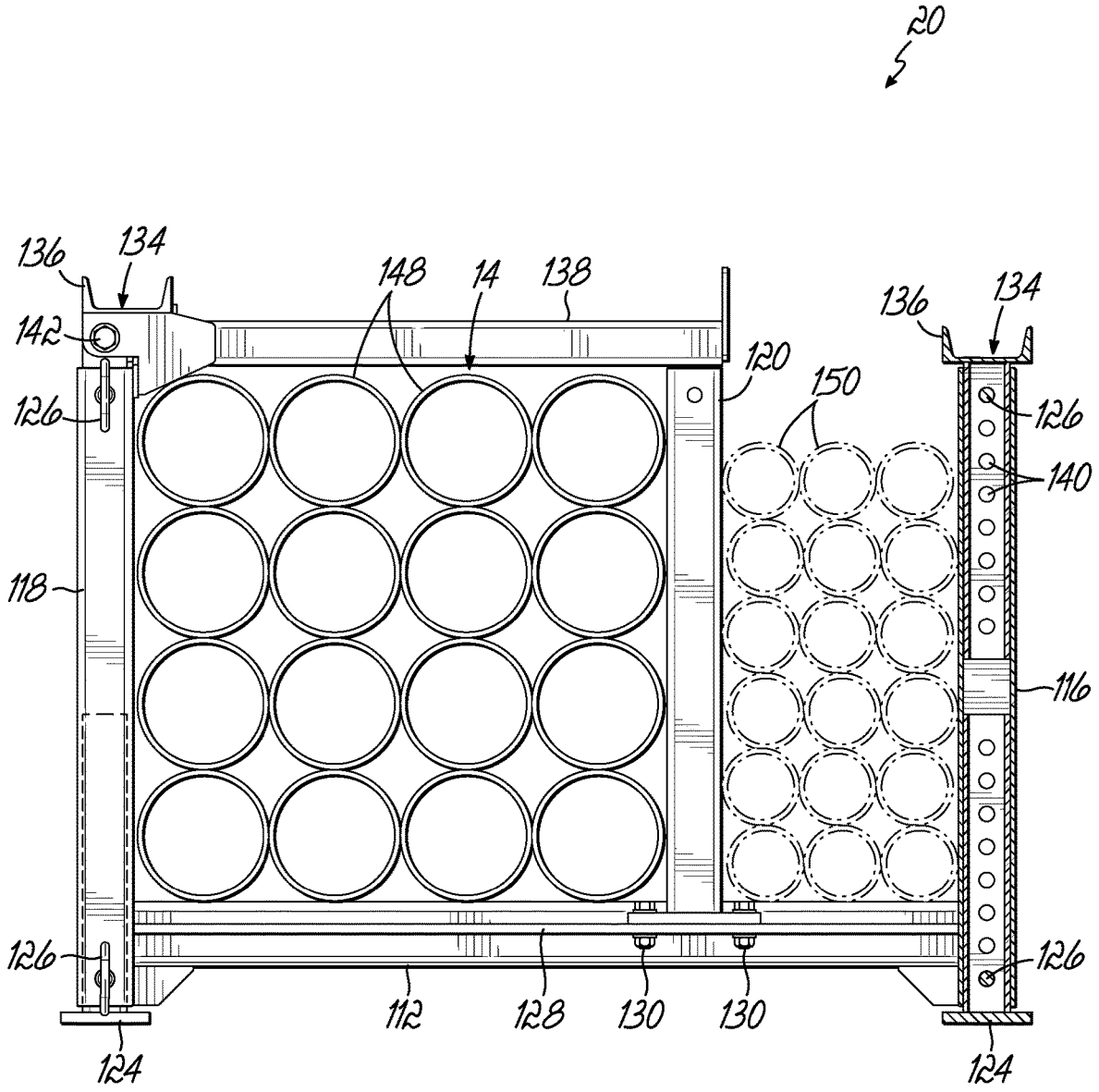
FIG. 10A is a side view of the sonic tooling holding rack of FIG. 9.
Figure 10B:
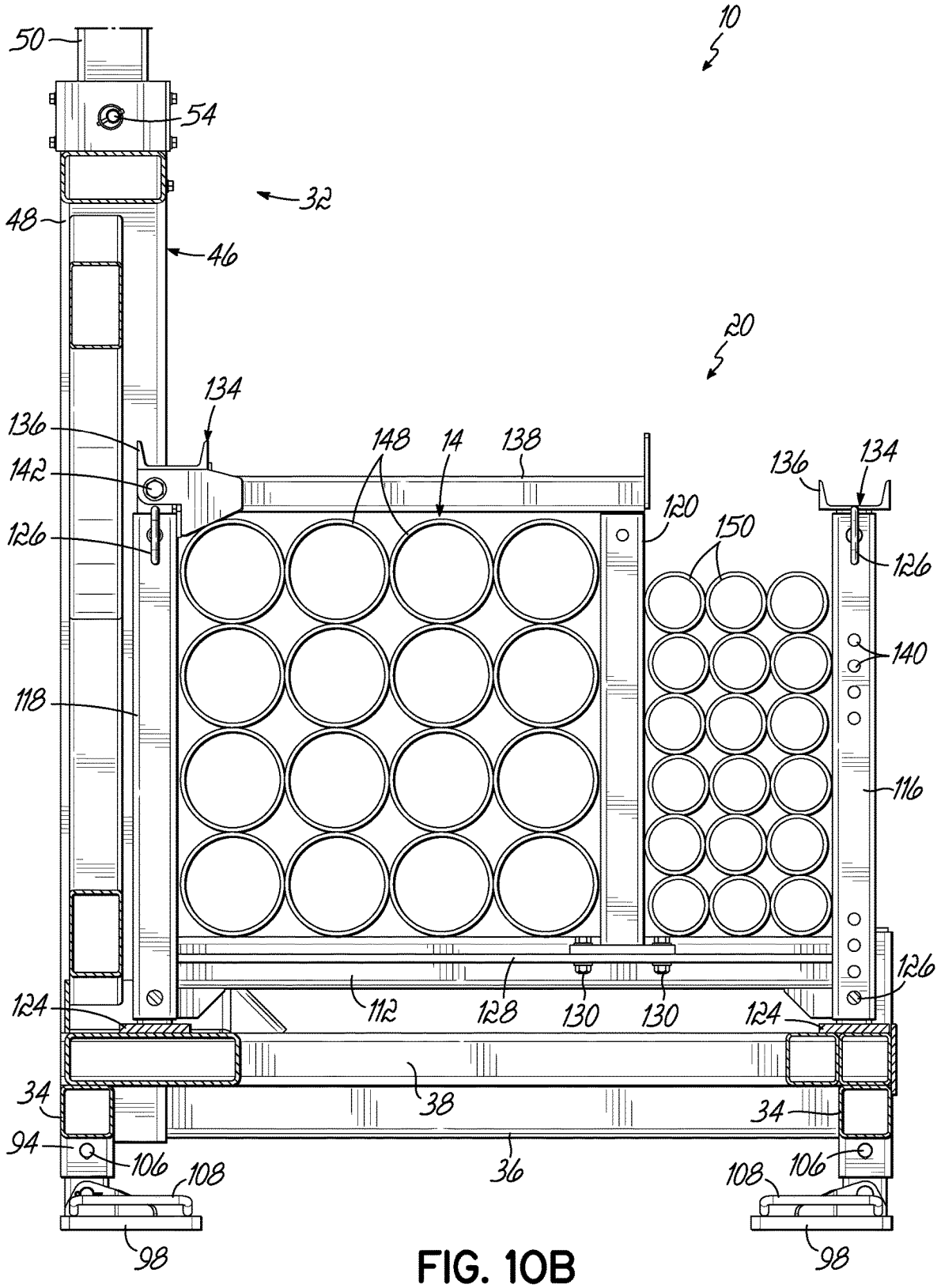
FIG. 10B is a side view of the sonic tooling holding rack of FIG. 9 sitting on the gantry support structure.

FIG. 10A is a side view of the sonic tooling holding rack 20 loaded with casings 148 and drill rods 150 shown in cross-section. FIG. 10B is a side view of the sonic tooling holding rack 20 placed onto the gantry support structure 18.

FIGS. 11A-11D illustrate a sequence of steps by which the sonic tooling holding rack 20 holding the sonic tooling 14 is loaded onto the gantry support structure 18 and the sonic tooling 14 is then lifted by the air hoist 68 to be coupled to a sonic drill rig 12. This sequence first starts with positioning the gantry support structure 18 near the sonic drill rig 12 and leveling the gantry support structure 18 using the adjustable corner supports 40 as required by the terrain. Once leveled, the upright frame structure 32 is raised up relative to the base frame structure 30 and fixed in place via pins 54. A source of high-pressure air (such as from the sonic drill rig 12) is then connected to flexible air hose 76 such that the air hoist 68 becomes operable.

Figure 11A:
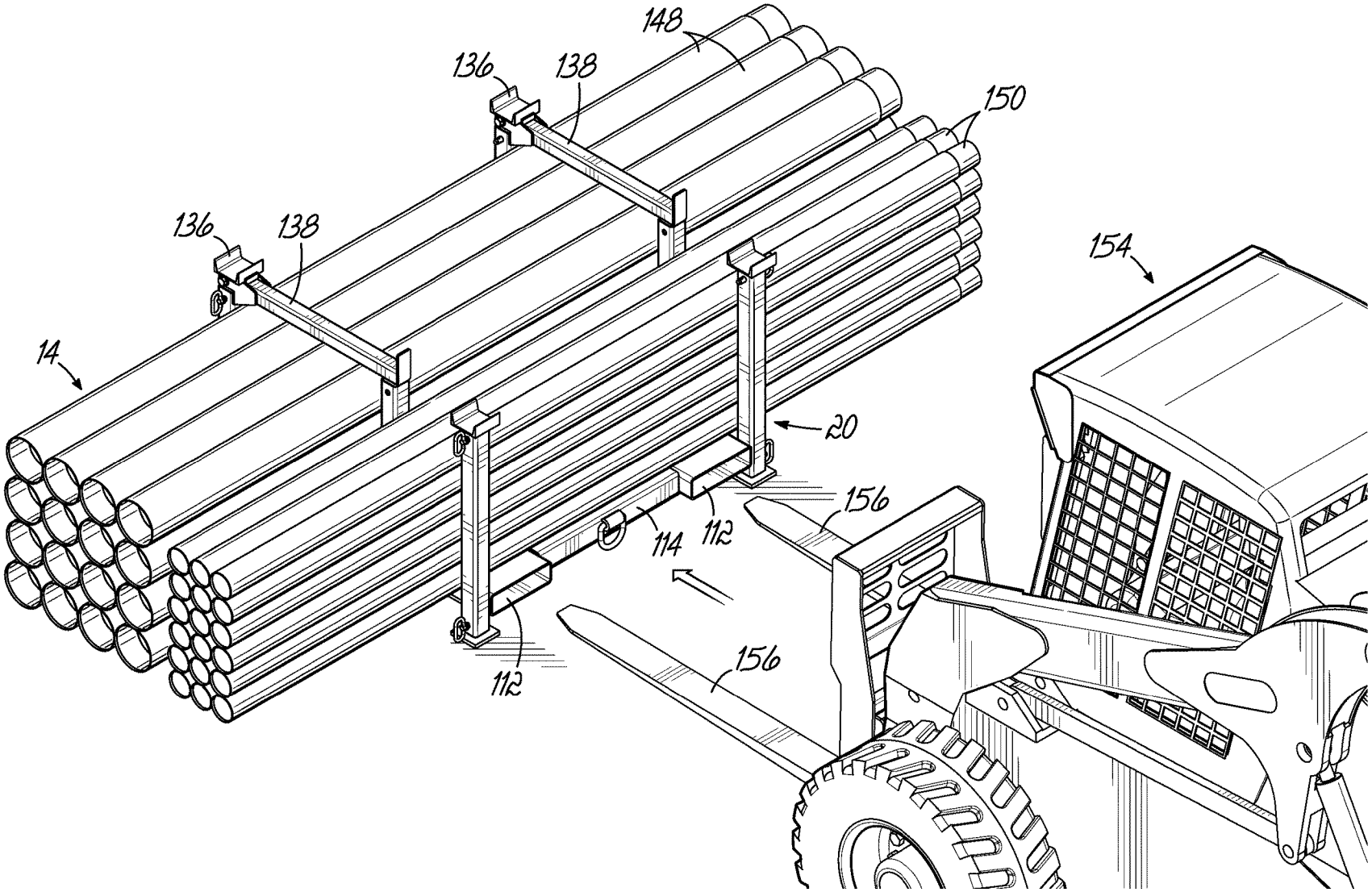
FIG. 11A is a perspective view of the sonic tooling holding rack of FIG. 9 being approached by forks of a lifting machine.
Figure 11B:
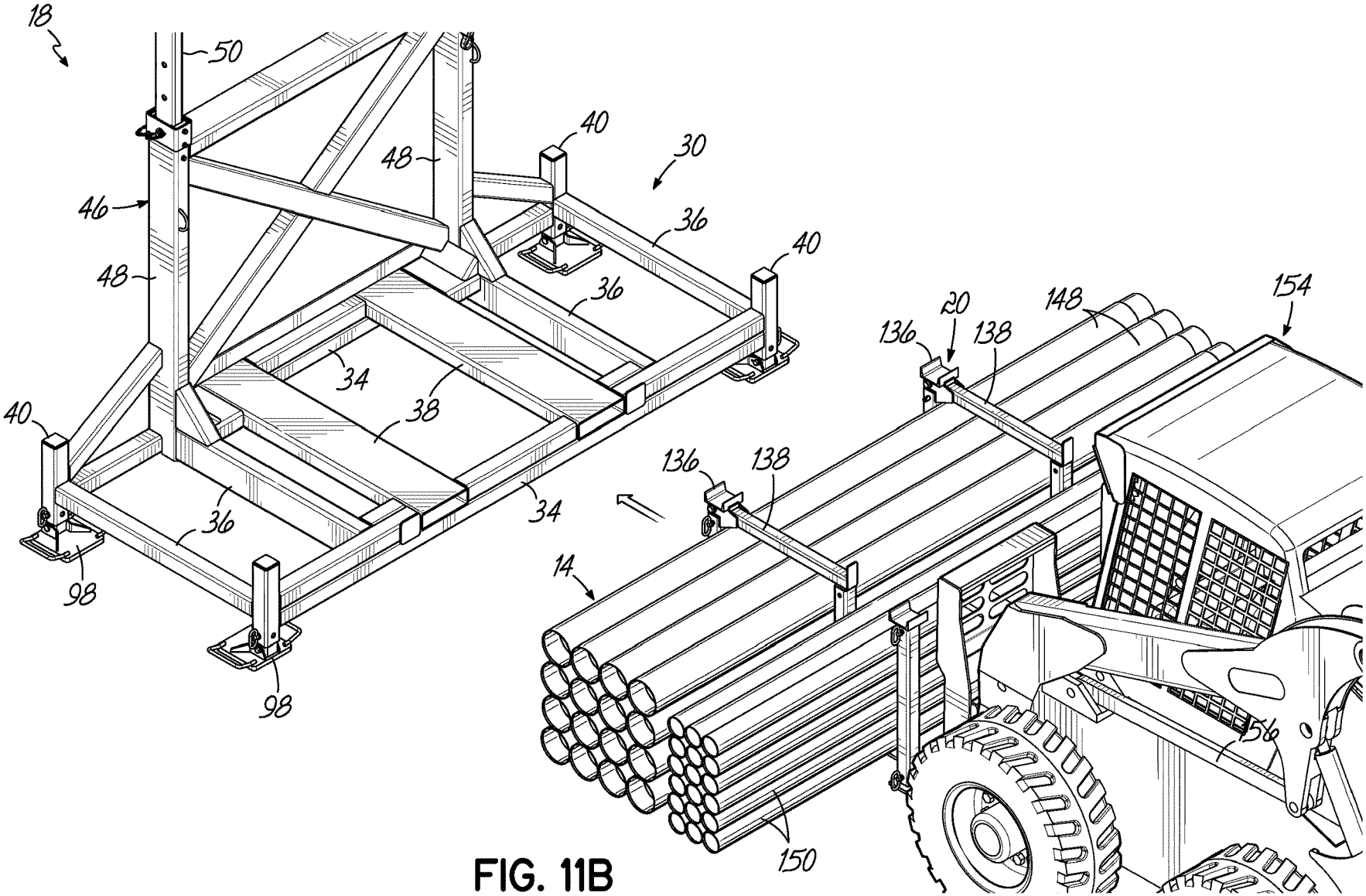
FIG. 11B is a perspective view of the sonic tooling holding rack of FIG. 9 being carried by the lifting machine to be placed on the gantry support structure of the sonic tooling handling apparatus of FIG. 1.
Figure 11C:
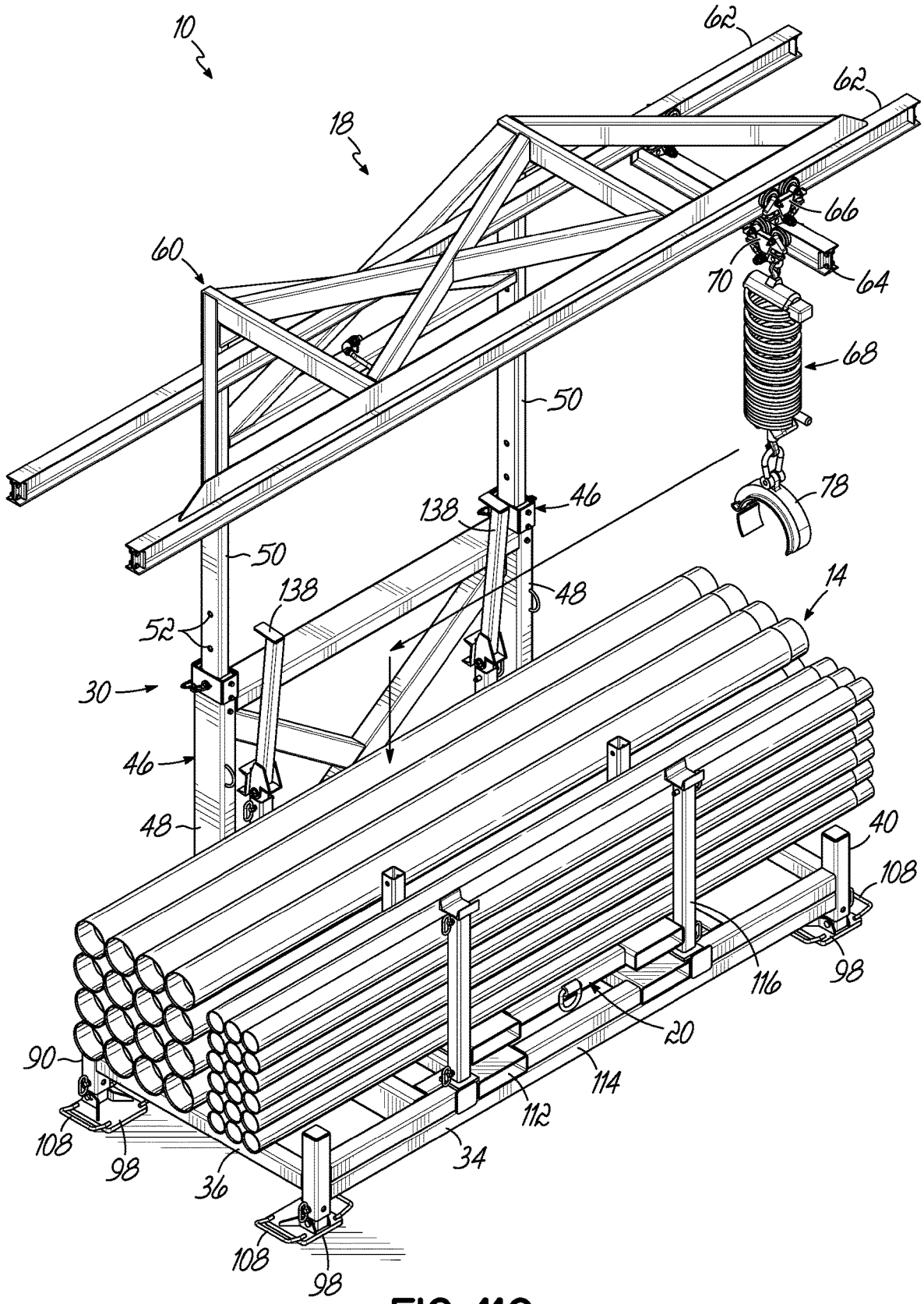
FIG. 11C is a perspective view of the sonic tooling handling apparatus of FIG. 1 with the sonic tooling holding rack loaded with drill rods and casings.
Figure 11D:
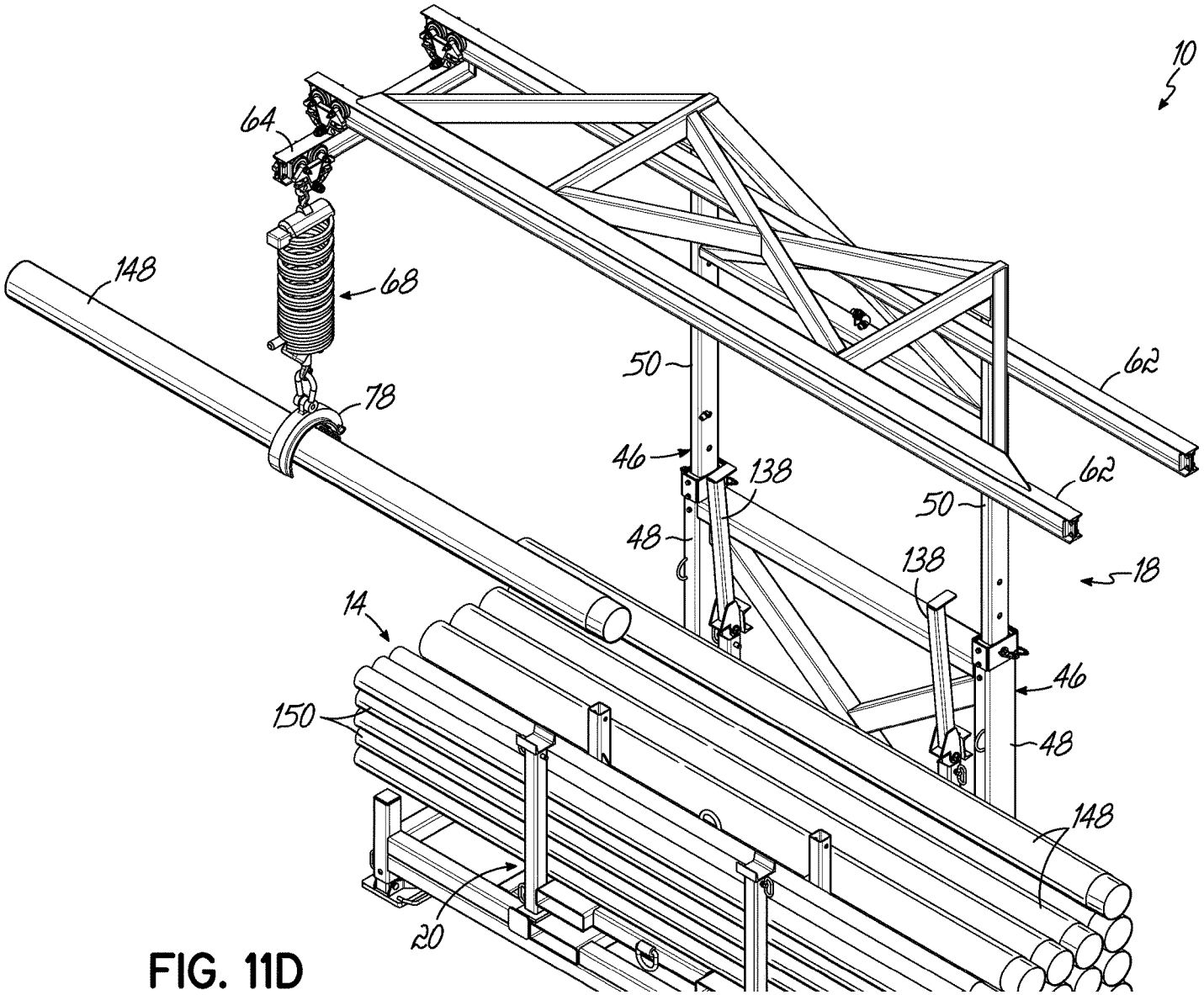
FIG. 11D is a perspective view of the sonic tooling handling apparatus of FIG. 1 with the air hoist lifting a casing to be attached to the sonic drill rig of FIG. 1
Figure 11E:
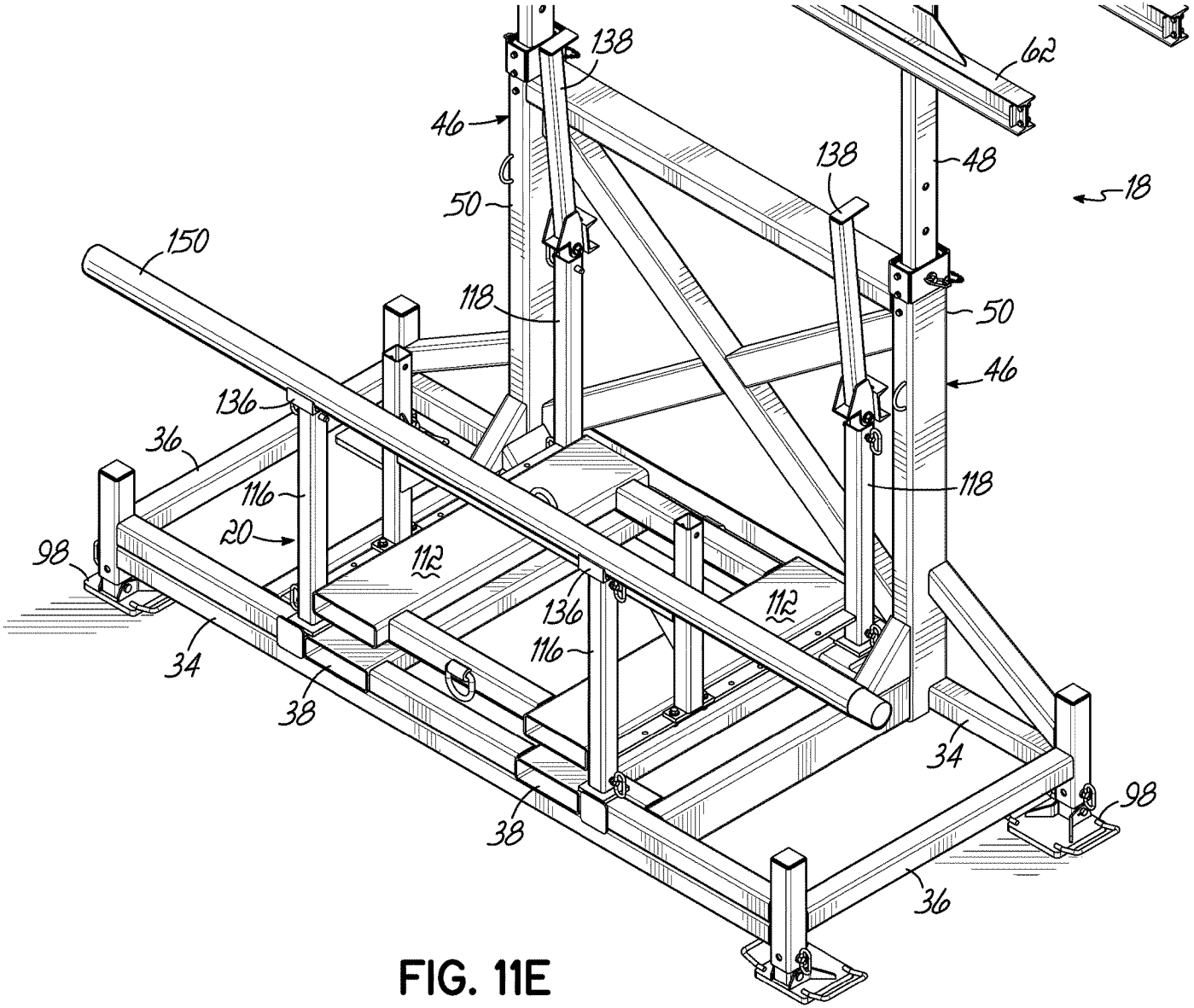
FIG. 11E is a perspective view of the sonic tooling handling apparatus of FIG. 1 with a drill rod positioned on cradles in preparation for being lifted by the air hoist.
Figure 12:
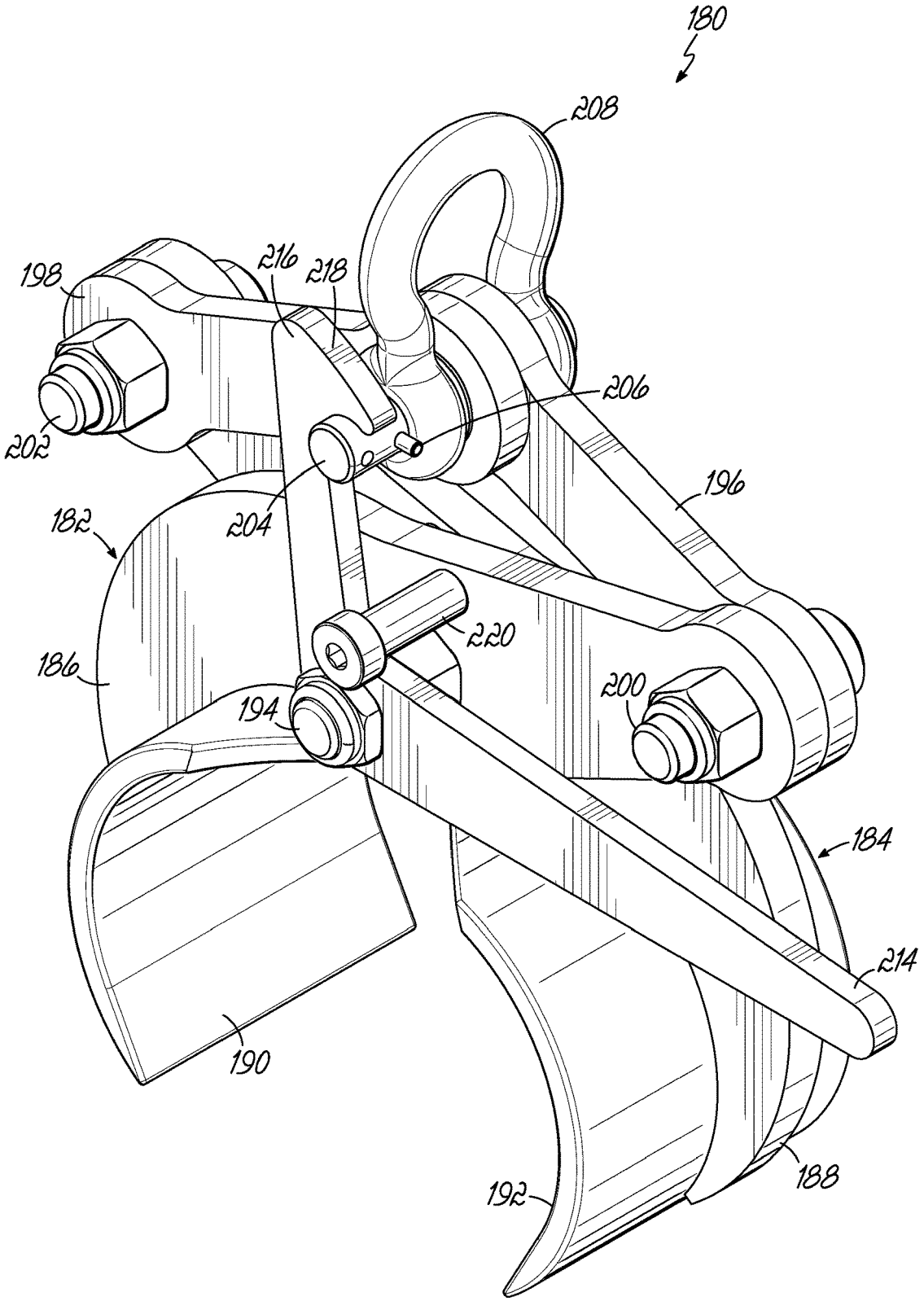
FIG. 12 is a front perspective view of a pipe tong in the open position according to one embodiment of the invention.

In FIG. 11A, a lifting machine 154, such as a forklift or a skid steering loader, with forks 156 is positioned to insert the forks 156 into open-ended box members 112 of the sonic tooling holding rack 20 loaded with the sonic tooling 14. In FIG. 11B, the lifting machine 154 is carrying the sonic tooling holding rack 20 loaded with the sonic tooling 14 towards the gantry support structure 18. In FIG. 11C, the sonic tooling holding rack 20 is positioned on the gantry support structure 18. The transverse extension members 138 are in the open position such that the air hoist 68 may connect to and lift up either a casing 148 or drill rod 150. In FIG. 11D, the pipe tong 78 has been clamped onto the casing 148 and the air hoist has lifted the casing 148 out of the sonic tooling holding rack 20. In this configuration, the casing 148 may be moved transversely from end-to-end of the transverse I-beam 64 and longitudinally from end-to-end of the longitudinal I-beam 62. In addition, the swivel hook 80 to which the pipe tong 78 is connected allows the casing 148 to rotate about the vertical axis of the air hoist 68. Collectively, the operator can translate and rotate the casing through a wide range of motion to facilitate coupling the casing 148 (or drill rod 150) to the sonic drill head. See, e.g., FIGS. 1B and 1C. The reverse sequence of steps may be used to move the sonic tooling 14 coupled to the sonic drill rig 12 back to the sonic tooling holding rack 20 in the reverse order described above. To transport the sonic tooling handling apparatus 10 from the job site, the upright frame structure 32 is placed in its lower most position and the adjustable corner supports 40 are fully retracted and the foot pads 98 are rotated towards the interior of the base frame structure 30. Advantageously, the sonic tooling handling apparatus 10 enables a single operator to couple the pipe tong 78 to the sonic tooling 14, lift the sonic tooling 14 with the air hoist 68, and move it along the longitudinal I-beams 62 and the transverse I-beam 64 to position for coupling to the sonic drill head 16.

The pipe tong 78 is able to couple to and pick up a casing 148 or a drill rod 150 when either of those is positioned directly next to other casings 148 or drill rods 150 in the sonic tooling holding rack 20 as shown in FIG. 11C. In practice, however, separating the desired casing 148 or drill rod 150 from the other casings 148 or drill rods 150 will make it easier for the operator to couple the pipe tong 78 to the casing 148 or drill rod 150. To that end, the cradle members 136 on the corner stanchions 116 of the sonic tooling holding rack 20 may be used as an initial staging location to place a drill rod 150, for example, before the pipe tong 78 is coupled to it. Typically, the operator will pick up one end of the drill rod 150 and place the drill rod 150 into one of the cradle members 136 approximately one third of the way down the length of the drill rod 150. This puts one end of the drill rod 150 into the air and the other end down and in contact with the remaining drill rods 150 remaining in the sonic tooling holding rack 20. The operator will then pull down on the up end of the drill rod 150 such that the drill rod 150 pivots on the cradle member 136 (much like a teeter tooter) such that the low end raises up. The operator then swings the drill rod 150 around such that it will also rest in the other cradle member 136 as illustrated in FIG. 11E. The operator may then couple the pipe tong 78 to the drill rod 150 and lift it with the air hoist 68. This staging process may also be used to couple the pipe tong 78 to the casings 148. The operator may then move the air hoist 68 and thus the pipe tong 78 in a longitudinal direction and/or a transverse direction so as to align an end of the drill rod 150 with the sonic drill head 16. Once drill rod 150 is aligned, the operator may couple the end of the drill rod 150 with sonic drill head 16 and then release the drill rod 150 from the pipe tong 78.

A benefit of the sonic tooling handling apparatus 10 described herein is that it is configured such that the operator may easily maneuver the sonic tooling 14 out of the sonic tooling holding rack 20 because the gantry support structure 18 and especially the base frame structure 30 does not have any vertical stanchions (or other vertical structure) at its corners or along its ends and sides so that the operator has nearly unobstructed access to the sonic tooling 14 in the sonic tooling holding rack 20. In addition, the corner supports 40 and the corners of base frame structure 30 are short and significantly shorter than corner stanchions 116, 118 on the sonic tooling holding rack. While the sonic tooling holding rack 20 does have two corner stanchions 116 along one side, those corner stanchions 116 do not impact the operator's access and ability to maneuver the sonic tooling 14 out of the sonic tooling holding rack 20. In addition, because there are no vertical stanchions at the corners of the sonic tooling handling apparatus 10 and especially the base frame structure 30 to impede the operator's movement, the operator may maintain positive control over the sonic tooling 14 at all times as the sonic tooling 14 is being removed from or returned to the sonic tooling holding rack 20. Moreover and as explained above, the sonic tooling handling apparatus 10 may load and unload the sonic tooling 14 from either end of the sonic tooling handling apparatus 10 depending on the site requirements. Consequently, the lack of vertical stanchions on all corners of the sonic tooling handling apparatus 10 and the base frame structure 30 means the operator's ability to maneuver and maintain positive control of the sonic tooling 14 is available regardless of where the sonic tooling handling apparatus 10 is positioned relative to the sonic drill rig 12.

Figure 13:
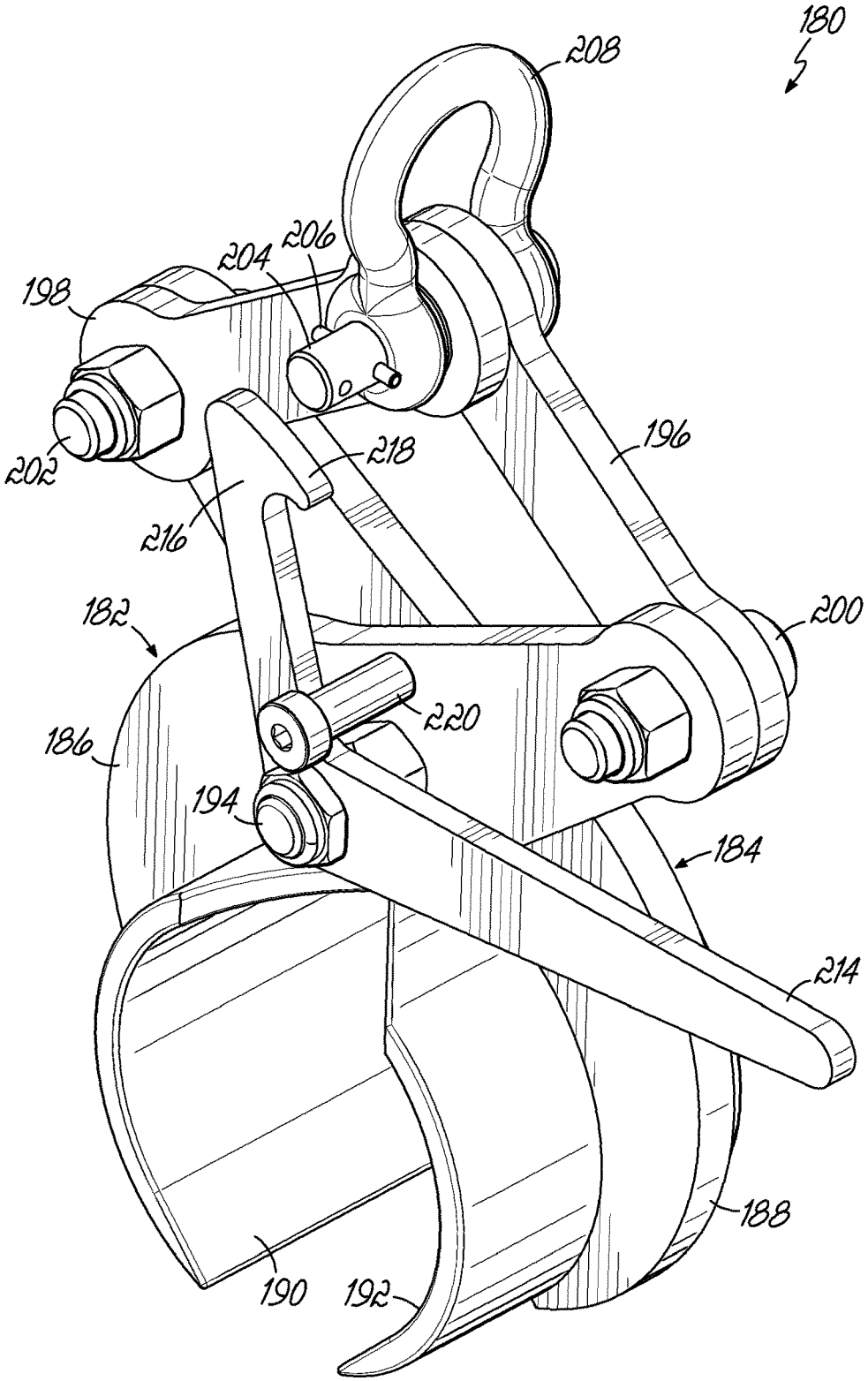
FIG. 13 is a front perspective view of the pipe tong of FIG. 12 in the closed position.
Figure 14:
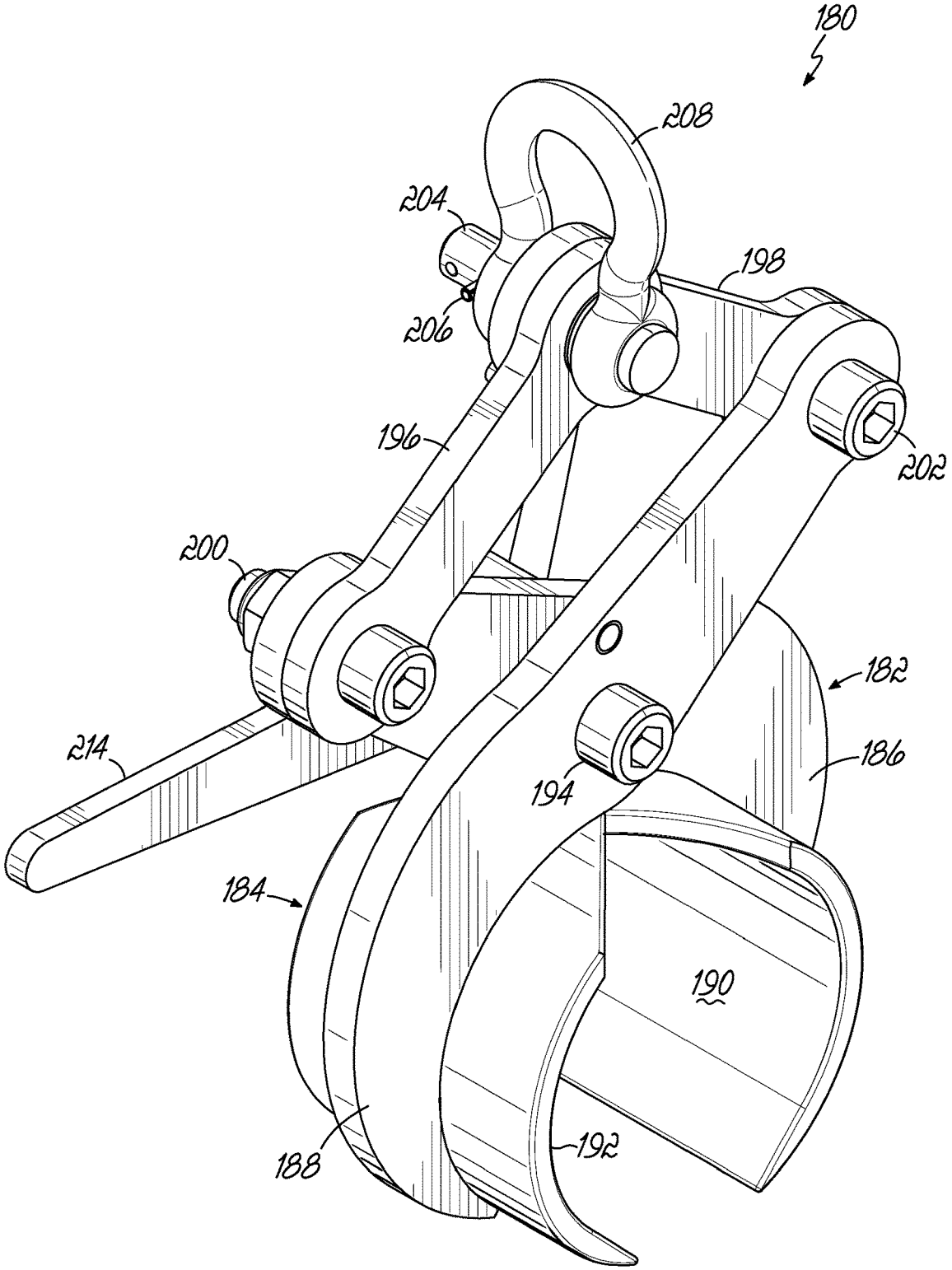
FIG. 14 is a rear perspective view of the pipe tong of FIG. 13.

One embodiment of pipe tong 78 is shown in FIGS. 4A, 4B, and 5. A second embodiment of a pipe tong 180 is shown in FIGS. 12-17. The pipe tong 180 is movable between an open position (FIG. 12) and a closed position (FIG. 13). The pipe tong 180 includes first and second gripping structures 182, 184, which include arcuate arms 186, 188 and curved jaws 190, 192. The curved contact pads are shaped to fit around the exterior surface of the sonic tooling 14 with a particular diameter. By way of example, but not limitation, the pipe tong 180 and the curved jaws 190, 192 in FIGS. 12-14 may be configured to clamp around and lift the sonic tooling 14 with a diameter of about 3½ inches. The pipe tong 180 may also be configured to clamp around sonic tooling with diameters less than or greater than 3½". The first and second gripping structures 182, 184 are pivotally connected to each other via a pin or bolt 194. First and second linking members 196, 198 are pivotally connected to the respective ends of the arcuate arms 186, 188 via pins or bolts 200, 202. The opposite ends of the first and second linking members 196, 198 are connected to each other via a clevis pin 204 held in place by a split pin or cotter key 206. A clevis 208 is also secured to the opposite ends of the first and second linking member 196, 198 via the clevis pin 204.

The pipe tong 180 further includes a latch lever 214 that pivots about pin 194. The latch lever includes a hooked end 216 that is configured to engage the clevis pin 204. To prevent an upper sloped surface 218 of the hooked end 216 from rotating past the clevis pin 204 when the pipe tong 180 moves to the closed position, the pipe tong 180 includes a stop pin 220. When the hooked end 216 engages the clevis pin 204, the pipe tong 180 is considered to be in the opened position and as such the gripping structures 182, 184 and the first and second linking members 196, 198 cannot move relative to each other. As the pipe tong 180 is positioned around the sonic tooling 14, the latch lever 214 may be rotated upwards to disengage the hooked end 216 from the clevis pin 204, which allows the gripping structures 182, 184 to drop down and surrounds the sonic tooling 14. As the air hoist 68 lifts upwardly on the clevis pin 204, the first and second linking members 196, 198 create a scissoring motion to rotate the gripping structures 182, 184 toward each other causing the curved jaws 190, 192 to positively grip the sonic tooling 14.

Figure 18:
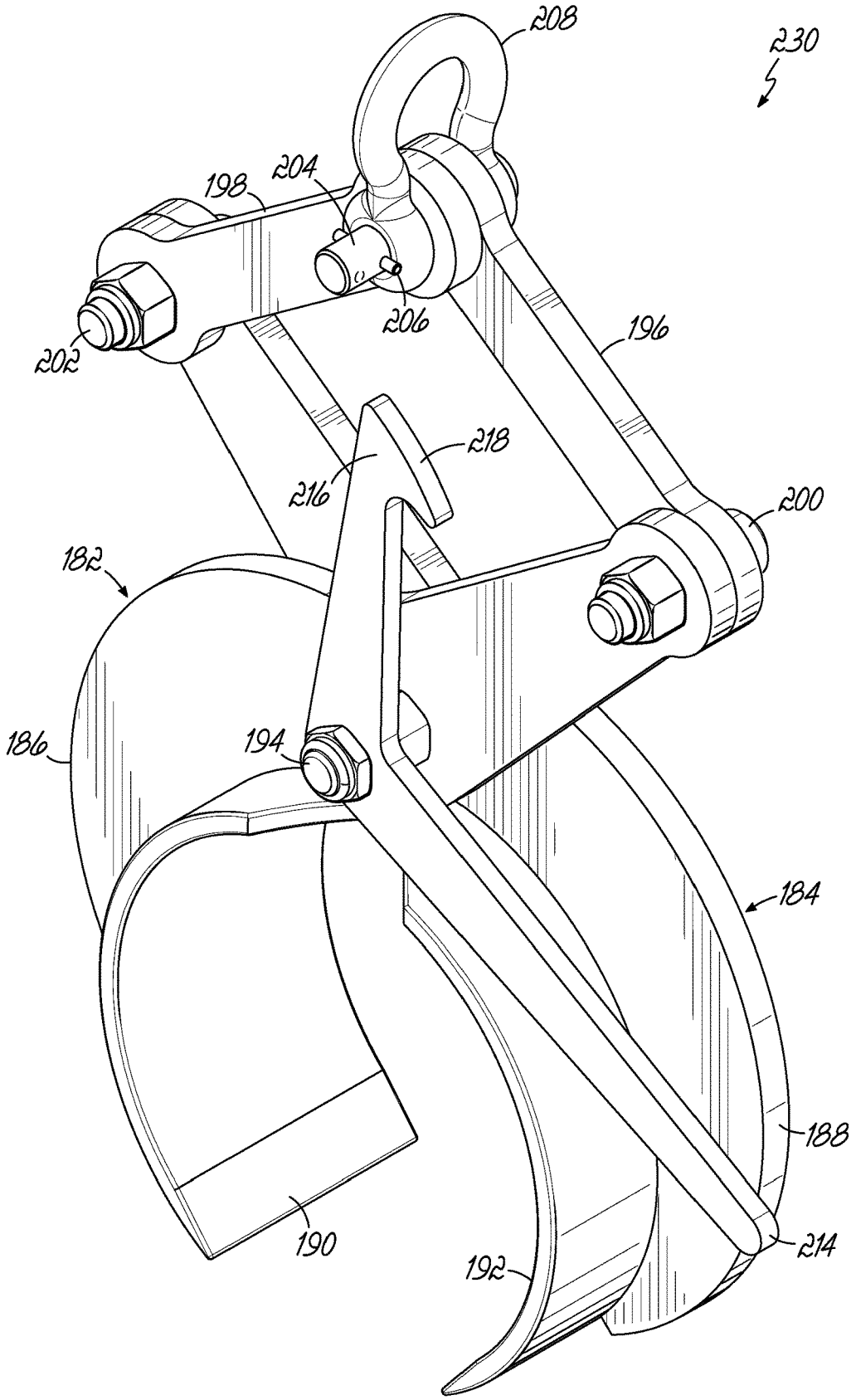
FIG. 18 is a front perspective view of a pipe tong in the closed position according to another embodiment of the invention.
Figure 19:
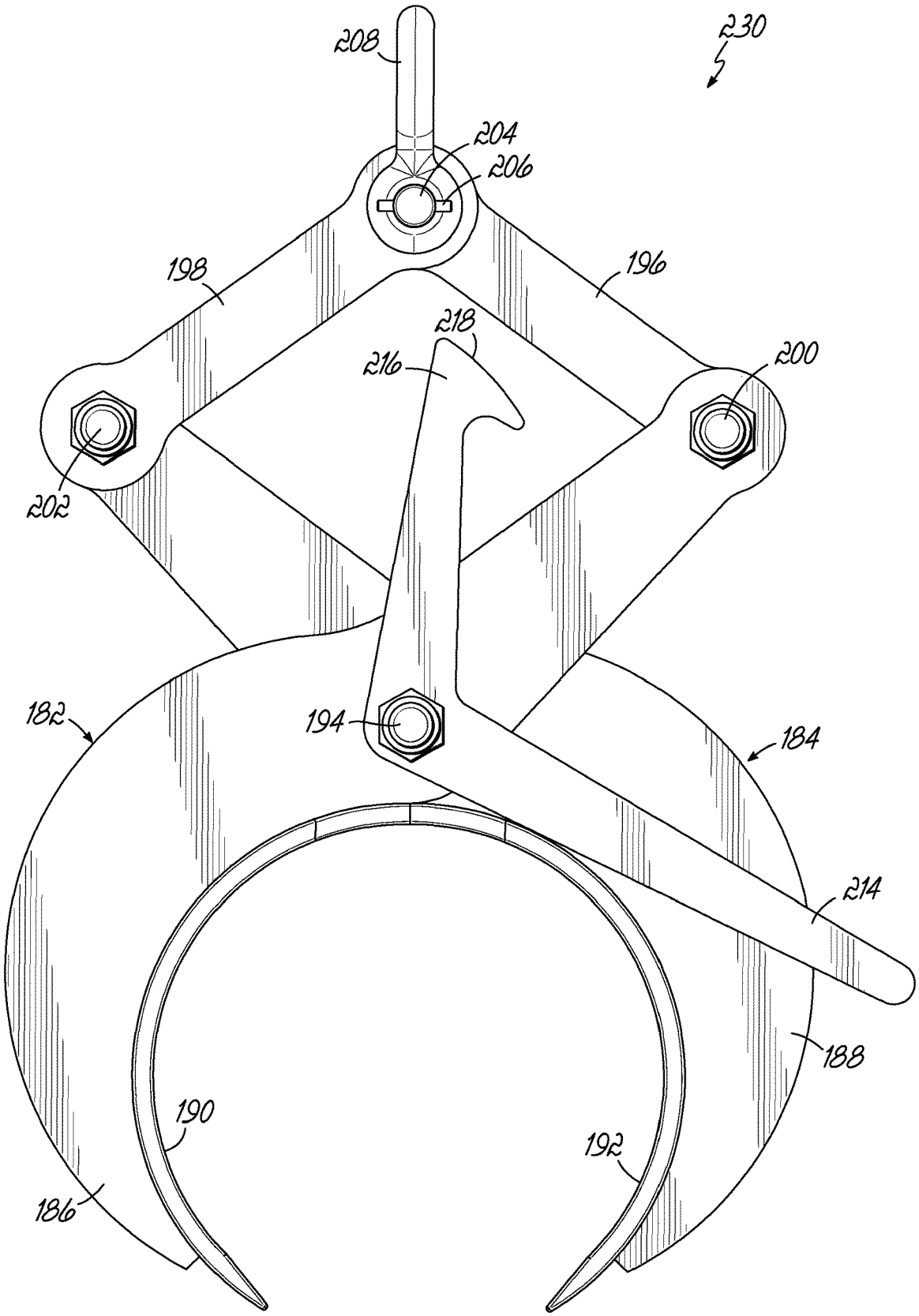
FIG. 19 is a front view of the pipe tong of FIG. 18.

Another embodiment of a pipe tong 230 is shown in FIGS. 18 and 19. Pipe tong 230 is essentially the same as pipe tong 180 except that pipe tong 230 does not have the stop pin 220. The pipe tong 230 may be configured to clamp around sonic tooling 14 with larger diameters, for example, but not limitation, of 4¾", 6", 7", 8", 9¼", 10½", and 12". The pipe tong 230 may also be configured to clamp around sonic tooling having other diameters, including diameters less than 4¾" and greater than 12" and any diameter in between. To accommodate the larger diameter sonic tooling 14, the curved jaw 192 is larger than that on the pipe tong 180. Consequently, the larger curved jaw 192 prevents the upper sloped surface 218 of the hooked end 216 from rotating past the clevis pin 204 when the pipe tong 180 moves to the closed position, eliminating the need for the stop pin 220 in the pipe tong 230. Other than the absence of the stop pin 220, the pipe tong 230 is structurally and functionally the same as the pipe tong 180.

Figure 15:
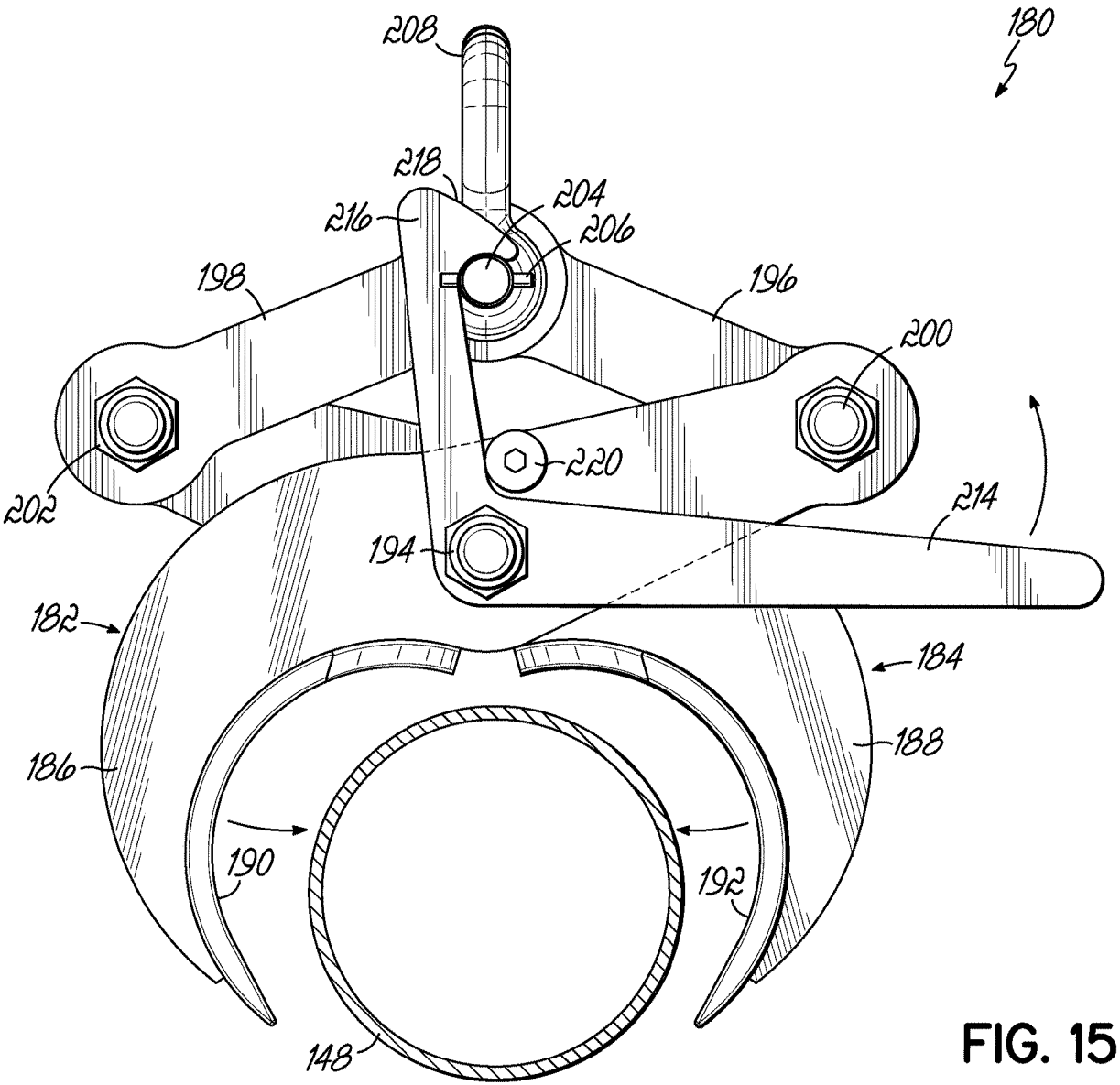
FIG. 15 is a front view of the pipe tong in FIG. 12 in the open position ready to clamp onto a piece of sonic tooling.
Figure 16:
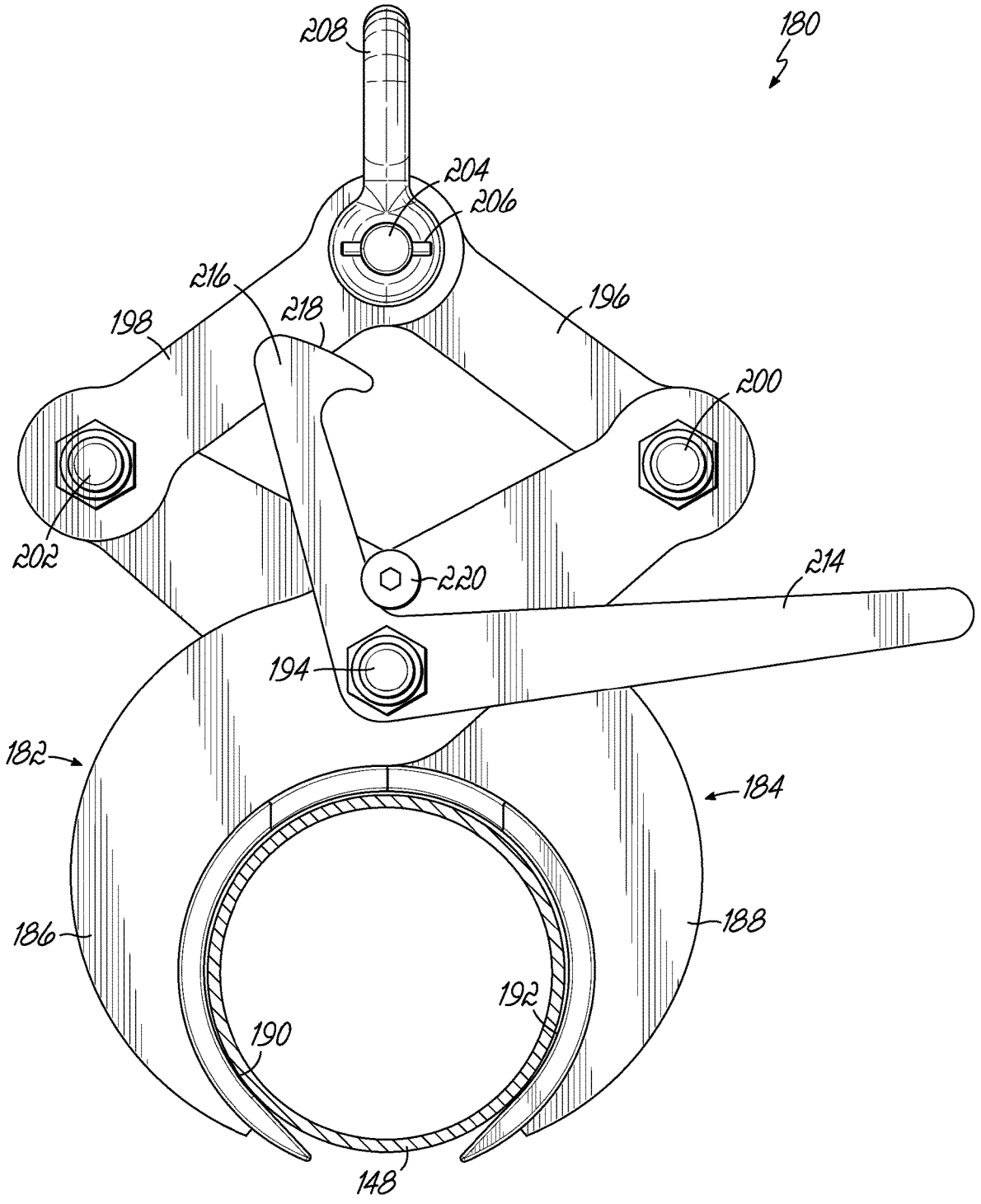
FIG. 16 is a front view of the pipe tong in FIG. 12 in the closed position clamped around a piece of sonic tooling.
Figure 17:
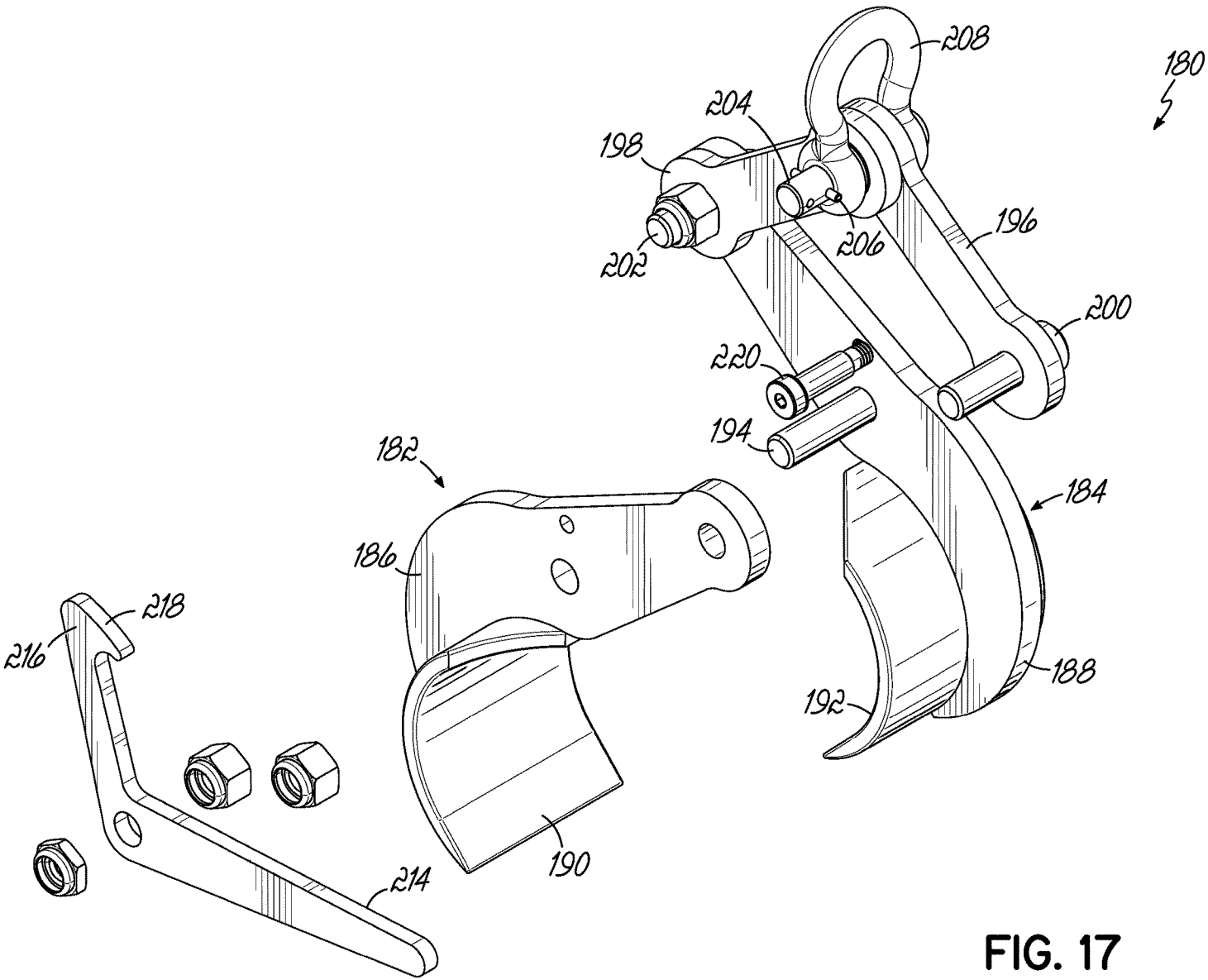
FIG. 17 is a partially disassembled view of the pipe tong in FIG. 12.

With reference to FIGS. 15 and 16, to lift a casing 148 (or drill rod 150) out of the sonic tooling holding rack 20, the pipe tong 180 in the opened position (FIG. 15) is lowered down via the air hoist 68 into position over the casing 148 and the latch lever 214 is released, i.e., disengaged from the clevis pin 204. The air hoist 68 is activated to move upwards, which lifts the clevis 208, causing the curved jaws 190, 192 to move toward and clamp the casing 148. The air hoist 68 lifts the clamped casing 148 (FIG. 16) to a desired height then the casing 148 is moved laterally and traversely along longitudinal I-beam 62 and transverse I-beam 64 for attachment to the sonic drill head 16. After the casing 148 is positively attached to the sonic drill head 16, the air hoist 68 is lowered, the pipe tong 180 moves to the opened position, and the latch lever 214 engages the clevis pin 204. The pipe tong 180 is then lifted away via the air hoist 68 and is now ready to attach to another casing 148 (or drill rod 150). The pipe tong 180 may also be used to remove the casing 148 from the sonic drill head 16 and return it to the sonic tooling holding rack 20 by reversing the steps used to attach the casing 148 to the sonic drill head 16.

While the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A sonic tooling handling apparatus comprising:

a gantry support structure including:

a base frame structure, an overhead frame structure operatively coupled to the base frame structure, the overhead frame structure having a pair of longitudinal beams with each longitudinal beam having a length and a transverse beam having a length coupled to the pair of longitudinal beams, the transverse beam being movable along at least a part of the length of each of the pair of longitudinal beams, and a lifting device operatively coupled to the transverse beam and movable along at least part of the transverse beam, the lifting device includes a sonic tooling clamp configured to clamp onto sonic tooling, the lifting device configured to raise or lower sonic tooling held by the sonic tooling clamp; and a sonic tooling holding rack having a plurality of stanchions configured to create at least one sonic tooling holding space for holding sonic tooling, the sonic tooling holding rack being configured to be removably mounted on the base frame structure of the gantry support structure, wherein the sonic tooling clamp is rotatably coupled to the lifting device such that sonic tooling clamped by the sonic tooling clamp may be rotated about a vertical axis of the lifting device.

2. The sonic tooling handling apparatus of claim 1, wherein the transverse beam is coupled to the pair of longitudinal beams by a first and second trolleys, each of the trolleys configured so that the transverse beam is movable along at least a part of the length of each of the pair of longitudinal beams.

3. The sonic tooling handling apparatus of claim 2, wherein the lifting device is coupled to the transverse beam by a third trolley, the third trolley configured so that the lifting device is movable along at least a part of the length of the transverse beam.

4. The sonic tooling handling apparatus of claim 1, wherein the lifting device is an air hoist configured to be operatively coupled to a source of high-pressure air.

5. The sonic tooling handling apparatus of claim 1, wherein the base frame structure has four corners, each corner being supported by an adjustable corner support with a foot pad, each corner support is independently vertically movable relative to the base frame structure to accommodate the sonic tooling handling apparatus sitting on an uneven support surface, each foot pad being pivotable to accommodate the support surface being sloped.

6. The sonic tooling handling apparatus of claim 1, wherein the gantry support structure includes an upright frame structure coupling the overhead frame structure to the base frame structure, the upright frame structure being selectably adjustable so as to change a vertical distance between the pair of longitudinal beams and the base frame structure.

7. The sonic tooling handling apparatus of claim 1, wherein the sonic tooling holding rack has four corners and the plurality of stanchions includes four corner stanchions, wherein the four corner stanchions are positioned at corresponding ones of the four corners, each of the four corner stanchions includes a cradle member configured to hold at least a portion of sonic tooling.

8. The sonic tooling handling apparatus of claim 7, wherein the plurality of stanchions includes two intermediate stanchions, wherein the two intermediate stanchions are positioned between the four corner stanchions so as to create first and second sonic tooling holding spaces for holding sonic tooling.

9. The sonic tooling handling apparatus of claim 8, wherein the two intermediate stanchions are movable relative to the four corner stanchions such that the size of the first and second sonic tooling holding spaces may either increase or decrease.

10. The sonic tooling handling apparatus of claim 8, wherein two of the four corner stanchions each include a transverse extension member that is configured to pivot between a first position and a second position, wherein in the first position the transverse extension member rests atop the intermediate stanchion.

11. The sonic tooling handling apparatus of claim 1, wherein an end of each of the pair of longitudinal beams extends outwardly beyond a first side edge of the base frame structure so that the lifting device may lower or raise sonic tooling beyond the first side edge of the base frame structure, and wherein an end of the transverse beam extends outwardly beyond a second side edge of the base frame structure so that the lifting device may lower or raise sonic tooling beyond the second side edge of the base frame structure.

12. The sonic tooling handling apparatus of claim 1, wherein the base frame structure has at least one corner and that at least one corner does not include a vertical stanchion thereon.

13. The sonic tooling handling apparatus of claim 1, wherein the base frame structure has four corners and none of those four corners includes a vertical stanchion thereon.

14. A sonic tooling handling apparatus comprising:

a gantry support structure including:

a base frame structure, an overhead frame structure operatively coupled to the base frame structure, the overhead frame structure having a pair of longitudinal beams with each longitudinal beam having a length and a transverse beam having a length coupled to the pair of longitudinal beams, the transverse beam being movable along at least a part of the length of each of the pair of longitudinal beams, and a lifting device operatively coupled to the transverse beam and movable along at least part of the transverse beam, the lifting device includes a sonic tooling clamp configured to clamp onto sonic tooling, the lifting device configured to raise or lower sonic tooling held by the sonic tooling clamp; and a sonic tooling holding rack having a plurality of stanchions configured to create at least one sonic tooling holding space for holding sonic tooling, the sonic tooling holding rack being configured to be removably mounted on the base frame structure of the gantry support structure, wherein the at least one sonic tooling holding space is configured such that when sonic tooling is held in the sonic tooling holding space, a longitudinal axis of the sonic tooling is generally parallel to a longitudinal axis running along the length of each of the pair of longitudinal beams.

15. A sonic tooling handling apparatus comprising:

a gantry support structure including:

a base frame structure having a pair of spaced-apart, transverse support members, an overhead frame structure operatively coupled to the base frame structure, the overhead frame structure having a pair of longitudinal beams with each longitudinal beam having a length and a transverse beam having a length coupled to the pair of longitudinal beams, the transverse beam being movable along at least a part of the length of each of the pair of longitudinal beams, and a lifting device operatively coupled to the transverse beam and movable along at least part of the transverse beam, the lifting device includes a sonic tooling clamp configured to clamp onto sonic tooling, the lifting device configured to raise or lower sonic tooling held by the sonic tooling clamp; and a sonic tooling holding rack having a plurality of stanchions configured to create at least one sonic tooling holding space for holding sonic tooling, the sonic tooling holding rack having a pair of spaced-apart, transverse support members, the sonic tooling holding rack being configured to be removably mounted on the base frame structure of the gantry support structure, wherein the transverse support members of the base frame structure are configured to contact and support the transverse support members of the sonic tooling holding rack when the sonic tooling holding rack is mounted on the base frame structure, and wherein the sonic tooling holding rack is configured to be removed from the base frame structure by disengaging at the transverse support members of the base frame structure.

16. A sonic tooling handling apparatus comprising:

a gantry support structure including:

a base frame structure defining an outer terminal periphery having at least a first side edge and a second side edge, an overhead frame structure operatively coupled to the base frame structure, the overhead frame structure having a pair of longitudinal beams with each longitudinal beam having a length and a transverse beam having a length coupled to the pair of longitudinal beams, the transverse beam being movable along at least a part of the length of each of the pair of longitudinal beams, and a lifting device operatively coupled to the transverse beam and movable along at least part of the transverse beam, the lifting device includes a sonic tooling clamp configured to clamp onto sonic tooling, the lifting device configured to raise or lower sonic tooling held by the sonic tooling clamp; and a sonic tooling holding rack having a plurality of stanchions configured to create at least one sonic tooling holding space for holding sonic tooling, the sonic tooling holding rack being configured to be removably mounted on the base frame structure of the gantry support structure, wherein an end of each of the pair of longitudinal beams extends outwardly beyond the first side edge of the base frame structure so that the lifting device may lower or raise sonic tooling beyond the first side edge of the outer terminal periphery of the base frame structure, and wherein an end of the transverse beam extends outwardly beyond the second side edge of the base frame so that the lifting device may lower or raise sonic tooling beyond the second side edge of the outer terminal periphery of the base frame structure.

* * * * *